US006617769B2

(12) United States Patent
Suzuki

(10) Patent No.: US 6,617,769 B2
(45) **Date of Patent: *Sep. 9, 2003**

(54) SPARK PLUG AND MOUNTING STRUCTURE OF THE SAME

(75) Inventor: Takahiro Suzuki, Nagoya (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/892,786

(22) Filed: Jun. 28, 2001

(65) Prior Publication Data

US 2002/0000765 A1 Jan. 3, 2002

(30) Foreign Application Priority Data

Jun. 30, 2000 (JP) ..... 2000-199191

(51) Int. Cl.[7] ..... H01T 13/08; H01T 13/00
(52) U.S. Cl. ..... 313/141; 313/143; 123/169 R
(58) Field of Search ..... 313/141, 143, 313/118, 137; 123/169 R, 169 PA, 193.5

(56) References Cited

U.S. PATENT DOCUMENTS 4,557,229 A * 12/1985 Kashima et al. ..... 123/169 EL
5,370,100 A * 12/1994 Benedikt et al. ..... 123/654
2002/0149308 A1 * 10/2002 Suzuki et al. ..... 313/141

FOREIGN PATENT DOCUMENTS

JP 2000-133411 5/2000

* cited by examiner

*Primary Examiner*—Nimeshkumar D. Patel
*Assistant Examiner*—Karabi Guharay
(74) *Attorney, Agent, or Firm*—Morgan, Lewis & Bockius LLP

(57) ABSTRACT

The spark plug has a top end portion of a main metal shell that is almost cylindrical on an outer circumferential face without having a plug attaching external thread screwed into the cylinder head. Further, the plug hole formed in the cylinder head has a top end counterpart corresponding to the top end portion of the main metal shell. And in the mounting structure of the spark plug into the cylinder head (plug hole), the clearance amount (ϕD−ϕd) satisfies a relation $$\phi D - \phi d \leqq 0.15 \text{ (unit: mm)}$$

where the outer diameter of the top end portion of the main metal shell is ϕd and the hole diameter of the top end counterpart of the plug hole is ϕD.

17 Claims, 16 Drawing Sheets

SPARK PLUG AND MOUNTING STRUCTURE OF THE SAME

BACKGROUND OF THE INVENTION

The present invention relates to a spark plug which can be mounted into a plug hole formed in a cylinder head without need of screwing into the plug hole, and a structure for mounting the spark plug.

A spark plug 10 used as an ignition source to a fuel-air mixture in the internal combustion engine comprises a shaft-shaped central electrode 3, an insulator 2 for surrounding the central electrode 3, and a main metal shell 1 for holding the insulator 2, as shown in FIG. 1, for example. The main metal shell 1 has a flange portion 11 with a plug bearing surface 13 formed on the tip side (where a spark discharge gap g is formed) and a top end portion 12 extending from the plug bearing surface 13 to the top end in an axial direction O. On a top end face of this top end portion 12, an ground electrode 4 for forming a spark discharge gap g in cooperation with the central electrode 3 is connected to form a connecting portion (ground electrode connecting portion) 17. Further, an external thread 12*a* is formed around an outer circumference of this top end portion 12. Also, a caulking portion 16, a hexagonal portion 15 and a caulking groove portion 14 are formed on the rear end side of the flange portion 11, with the external thread 12*a* formed around the outer circumference of the top end portion 12.

More particularly, the insulator 2 comprises a head portion 2*b* formed with a corrugation 2*c*, a diameter portion 2*e* having the greatest diameter, a middle trunk portion 2*g* having a smaller diameter than the diameter portion 2*e*, and a leg length portion 2*i* located at the top-most end. Generally, an engagement face 2*h*, which is a connecting portion between the leg length portion 2*i* and the middle trunk portion 2*g*, is engaged with a main metal shell side engaging portion 18 (more particularly a face for engaging the insulator) protruded inwardly into an inner circumferential face of the main metal shell 1 via a packing 51. The engagement face 2*h* of this insulator 2 is intimately contacted with the main metal shell side engaging portion 18 via the packing 51 to retain air-tightness between the insulator 2 and the main metal shell 1, and makes a part of a main passage for diffusing a heat flowing into the central electrode 3 and the leg length portion 2*i* of the insulator 2, through the insulator 2, the packing 51, the metal shell side engaging portion 18, and the top end portion 12 (external thread 12*a*) to a cylinder head as will be described later.

In addition, this spark plug 10 is mounted on the cylinder head of the internal combustion engine, when in use. When the spark plug 10 is mounted on the cylinder head, the spark plug 10 is inserted into the plug hole formed in the cylinder head, and the external thread 12*a* formed at the top end portion 12 of the main metal shell 1 is screwed into an internal thread formed in the plug hole at a predetermined torque, with a plug wrench set on the hexagonal portion 15 of the main metal shell 1.

When the spark plug 10 is correctly rotated around a central axis of the plug hole having the internal thread therein, the spark plug 10 can be fastened into the plug hole without problem. However, if the spark plug 10 is rotated in a state of being slanted from the central axis of the plug hole, the external thread 12*a* is not correctly mated with the internal thread, resulting in a so-called gall state. Therefore, the external thread 12*a* or the internal thread may be damaged, and in extreme cases, a blow-by of a combustion gas from the combustion chamber is incurred so that the top end portion 12 of the main metal shell 1 or the central electrode 3 is heated to high temperatures, with the risk of possibly giving rise to a preignition or melting away the electrode.

SUMMARY OF THE INVENTION

In order to prevent the possible risk from generating, it can be conceived to construct a spark plug mounting structure as follow. The spark plug 10 (top end portion 12) may be inserted with a fine clearance into the plug hole, while the external thread 12*a* at the top end portion 12 of the main metal shell 1 and the internal thread in the plug hole are not formed. The spark plug 10 is then secured to the cylinder head by a plug fixture separately.

However, since there is a clearance between the top end portion 12 and an inner wall face of the plug hole with a constitution having no external thread 12 at the top end portion 12, the diffusion of the heat becomes difficult. Therefore, the temperature of the central electrode 3 is prone to rise, leading to the risk of giving rise to preignition or melting away the electrode.

This invention has been achieved in the light of the aforementioned problems, and it is an object of the invention to provide a spark plug and a spark plug mounting structure for mounting the spark plug into a plug hole formed in a cylinder head, in which the spark plug is easily mounted in the plug hole and can diffuse the heat excellently to have an improved heat resistance.

The above object can be achieved by, according to the present invention, a spark plug mounting structure comprising:

a spark plug including, a central electrode extending in an axial direction thereof, an insulator having a tip end portion which surrounds the outer circumferential face of the central electrode, and a main metal shell holding the insulator, the main metal shell having a flange portion with a plug bearing surface at a tip end of the flange portion, and the main metal shell having a top end portion which extends in an axial direction thereof from the plug bearing surface to a tip end side of the main metal shell; and a cylinder head having plug hole with a top end couterpart which receives the top end portion of the main metal shell, wherein the top end portion of the main metal shell is formed into a substantially cylindrical shape having an outer circumferential face on which no external thread is provided, and the top end portion of the main metal shell and the top end counter part of the plug hole satisfies a following relation, $$\phi D - \phi d \leqq 0.15$$

where ϕd (unit: mm) defines the outer diameter of the top end portion, and ϕD (unit: mm) denotes the inner diameter of the top end counterpart.

Also, according to the invention, there is provided a spark plug adapted to be mounted in a plug hole formed in a cylinder head, the spark plug comprising;

a central electrode extending in an axial direction thereof;

an insulator having a tip end portion which surrounds the outer circumferential face of the central electrode; and a main metal shell holding the insulator, the main metal shell having a flange portion with a plug bearing surface at a tip end of the flange portion, and the main metal shell having a top end portion which extends in an axial direction thereof from the plug bearing surface to a tip end side of the main metal shell, wherein the top end portion of the main metal shell is formed into a substantially cylindrical shape having an outer circumferential face on which no external thread is provided, and the outer diameter of the top end portion satisfying a following relation, $$\phi D-\phi d \leqq 0.15$$

where $\phi d$ (unit: mm) defines the outer diameter of the top end portion of the main metal shell, and $\phi D$ (unit: mm) denotes the inner diameter of a top end counterpart of the plug hole where is in confront with the top end portion.

With such a constitution of the invention, the top end portion of the main metal shell constituting the spark plug is formed substantially cylindrical without having a plug attaching external thread on the outer circumference. Thereby, when mounted, the spark plug is only inserted with a fine clearance into the plug hole, without needs of the screwing operation employing a plug wrench. In particular, the DOHC engines lately developed have mostly the suction and exhaust valves of large area, and the plug hole is designed deep, but the spark plug can be mounted only inserting with a play into the plug hole of this engine. Accordingly, the spark plug can be easily mounted without fear of damaging the thread portion which is occurred for a conventional spark plug when the external thread of the main metal shell is not mated with the internal thread of the plug hole.

The plug hole may has a flange counterpart and a top end counterpart corresponding in the outer peripheral shape to the flange portion and the top end portion of the main metal shell, respectively.

By the way, since the top end portion of the main metal shell is shaped substantially cylindrical on the outer circumferential face, the heat that could be conventionally escaped from the external thread formed in the top end portion to the cylinder head (plug hole inner wall face) becomes difficult to be diffused. Namely, assuming that the outer diameter of the top end portion in the main metal shell is $\phi d$ (unit: mm), and the hole diameter of the top end counterpart in the plug hole is $\phi D$ (unit: mm), when the clearance amount ($\phi D-\phi d$) is extremely small, the heat flowing into the main metal shell can be sufficiently diffused into the plug hole inner wall face. When this clearance amount ($\phi D-\phi d$) is relatively large, the passage for diffusing the heat becomes insufficient.

Namely, there is a relatively large air layer (layer formed by the air) interposed in the clearance between the top end portion of the main metal shell and the plug hole inner wall face (top end counterpart of the plug hole). And when this air layer is exposed to the combustion gases at high temperatures, this air layer functions as an adiabatic layer to prevent the heat flowing into the top end portion of the main metal shell from being diffused to the plug hole inner wall face. Therefore, the temperatures of the insulator, the central electrode and the ground electrode are prone to rise, possibly giving rise to a preignition or melting away the electrode.

On the contrary, with the spark plug of the invention, it should be noted that the clearance amount ($\phi D-\phi d$) is set to satisfy the relation $\phi D-\phi d \leqq 0.15$ mm With the mounting structure having the clearance amount ($\phi D-\phi d$) set to satisfy the above relation, the heat flowing from the insulator, the central electrode and the ground electrode into the main metal shell can be diffused through the top end portion of the main metal shell into the cylinder head rapidly. As a result, the central electrode, the insulator and the ground electrode are maintained at low temperatures, with the heat resistance being equivalent or superior to that of the spark plug having formed the external thread in the top end portion, whereby the spark plug and the mounting structure can be produced which have less risk of giving rise to preignition or melting away the electrode. The range of the clearance amount ($\phi D-\phi d$) is preferably 0.05 mm$\leqq\phi D-\phi d\leqq$0.15 mm in the light of the easiness of inserting the spark plug into the cylinder head, and more preferably 0.05 mm$\leqq\phi D-\phi d$ 0.10 mm in view of the easiness of inserting the spark plug and the good heat resistance.

The reason why the heat resistance of the spark plug can be obtained excellently when the clearance amount ($\phi D-\phi d$) is less than or equal to 0.15 mm is that the thickness of the air layer itself interposed is extremely reduced, there is less adiabatic effect with this air layer, and the heat from the top end portion can be effectively diffused via the air layer into the plug hole inner wall face. Also, another reason is that because the main metal shell is made of metal material, when the clearance amount ($\phi D-\phi d$) is less than or equal to 0.15 mm, the main metal shell (top end portion) is exposed to the combustion gases at high temperatures to cause the top end portion to be thermally expanded, and allow the top end portion to come into contact with the plug hole inner wall face effectively. Consequently, it is conceived that the passage for diffusing the heat from the top end portion of the main metal shell to the plug hole inner wall face can be effectively secured.

By the way, the heat flowing into the central electrode or the insulator is passed by way of the metal shell side engaging portion (more particularly the face for engaging the insulator in the metal shell side engaging portion) that is protruded inwardly around the inner circumferential face of the main metal shell to engage the insulator, as its diffusion passage. And this heat is diffused from the metal shell side engaging portion through the top end portion into the cylinder head (plug hole inner face) and through the plug bearing surface of the flange portion into the cylinder head (plug hole inner wall face). From this, the plug bearing surface is one of the main passages for diffusing the heat flowing into the central electrode or the insulator, in addition to the top end portion of the main metal shell.

Thus, with the spark plug as described above, the distance L (unit: mm) measured axially toward the tip from a top end of the plug bearing surface to a base end of the shell side engaging portion should satisfy a relation $-6\leqq L\leqq 6$.

With such a constitution, the heat flowing from the insulator or the central electrode into the metal shell side engaging portion (more particularly face for engaging the insulator of the metal shell side engaging portion) can be passed into the top end portion, and the plug bearing surface easily, and the heat flowing into the insulator or the central electrode can be diffused efficiently from the plug bearing surface and the top end portion into the cylinder head (plug hole inner wall face). As a result, the central electrode and the insulator can be maintained at low temperatures, making it possible to provide the spark plug superior in the heat resistance and the mounting structure thereof. Note that the rang of the distance L may be preferably in the relation $-3\leqq L\leqq 6$ in respect of the excellent heat resistance.

Herein, the base end of the metal shell side engaging portion that is a reference for measuring the distance L indicates the edge closest to the base end side in the metal shell engaging portion, when the face for engaging the insulator is slanted with respect to the axis, or tapered. On the other hand, when the face for engaging the insulator is perpendicular to the axis, or flat, the axial position of the base end side edge coincides with the axial position of the face for engaging the insulator. Similarly, the top end of the plug bearing surface indicates the edge closest to the top end side, when the plug bearing surface is slanted with respect to the axis, or tapered. On the other hand, when the plug bearing surface is perpendicular to the axis, or flat, the axial position of the top end coincides with the axial position of the plug bearing surface.

Further, the spark plug according to the invention comprises one or more ground electrodes having one end connected to the main metal shell to form an ground electrode connecting portion, with the other end being opposed to the central electrode via a spark discharge gap, wherein at least one of a main portion and a top end portion of the main metal shell is made a fitting position restriction shape to be fitted at one or more positions with at least one of the main portion counterpart and the top end counterpart in the plug hole, when rotating the spark plug axially while inserting the spark plug into the plug hole, wherein the relation between one or more formation positions of the ground electrode connecting portion and at least one of the main portion and the top end portion of the main metal shell that is made the fitting position restriction shape is substantially equivalent with regard to the spark plugs with the same parts number.

With such a constitution, at least one of the flange portion and the top end portion of the main metal shell is made the fitting position restriction shape with respect to the plug hole (at least one of the flange counterpart and the top end counterpart of the plug hole), and the relation between one or more formation positions of the ground electrode connecting portion and the flange portion or the top end portion of the main metal shell that is made the fitting position restriction shape is substantially the same. In this way, if the spark plug is inserted and fitted into the plug hole, the ground electrode connecting portion is restricted to a specific position in the circumferential direction around the axial line of the plug hole itself. Namely, only by inserting the spark plug into the plug hole, the ground electrode of the spark plug can be set at the specific position within the combustion chamber easily and securely.

Usually, it is known that to keep the ground electrode from impeding the flow of a swirl arising at the compression stroke, there is the optimal positional relation between the swirl flow direction and the formation position of the ground electrode connecting portion. The positional relation between the swirl flow direction and the ground electrode connecting portion is taken into account beforehand to restrict the relation between the formation position of the ground electrode connecting portion and the flange portion or top end portion that is made the fitting position restriction shape, so that the relation between the swirl flow direction and the formation position of the ground electrode connecting portion can be held constant at any time for each cylinder or internal combustion engine. As a result, there is less dispersion in the ignitability for the cylinders or internal combustion engines, and there is excellent ignitability, so that the internal combustion engine can be driven at uniform air fuel ratio (A/F), and at lean air fuel ratio.

Herein, the fitting position restriction shape may be arbitrary, so far as the spark plug can be fitted at one or more positions into the plug hole, if inserted into the plug hole while being rotated axially, in disposing the flange portion or top end portion of the main metal shell corresponding to the flange counterpart or top end counterpart of the plug hole. More specifically, the key groove extending axially may be formed in the plug hole, and the key projection (streak or projection) fitted into the key groove provided in the top end portion, or conversely, the key projection may be provided in the plug hole and the key groove provided on the main metal shell side. Further, the flange portion of the main metal shell may be beveled and the plug hole adapted to this beveling. Additionally, the main portion and the flange counterpart of the plug hole may be shaped to be oval, elliptical or polygonal in cross section.

Further, the spark plug may further comprise a barrel portion integrated with the main metal shell of the spark plug to be unrotatable about the axis thereof, and an ignition coil portion, which is accommodated within the barrel portion and has a primary winding and a secondary winding, for applying a high voltage for ignition that is generated in the secondary winding to the spark plug, thereby constituting a coil integral-type spark plug.

Employing this coil integral-type spark plug, when mounted into the plug hole, the spark plug can be inserted with a play into the plug hole formed in the deep region such as the DOHC engine, and mounted only by securing a projection portion formed on the barrel portion with the cylinder head. Namely, the coil integral-type spark plug of the invention does not need the screwing operation of the main metal shell employing a plug wrench, and can be easily mounted. Accordingly, there is less fear of causing a galling state by rotating the spark plug notwithstanding the external thread groove of the main metal shell does not mesh with the internal thread groove of the plug hole.

In this invention, when the clearance amount ($\phi D-\phi d$) between the bore diameter $\phi D$ of the top end counterpart for the plug hole and the bore diameter $\phi d$ of the top end portion for the main metal shell is as quite small as 0.15 mm or less, an operation of mounting the spark plug into the plug hole can be carried out easily and securely, employing the coil integral-type spark plug.

Further, employing the coil integral-type spark plug, the plug bearing surface of the flange portion can be stably brought into contact with the cylinder head directly or indirectly via the other member (specifically a gasket).

BRIEF DESCRIPTION OF THE DRAWINGS

FIG. 15 is an explanatory view for explaining a procedure for assembling the coil integral-type spark plug of the example 3, in which

DETAILED EXPLANATION OF THE PREFERRED EMBODIMENTS

The preferred embodiments of the present invention will be described below with reference to the accompanying drawings.

Figure 1:
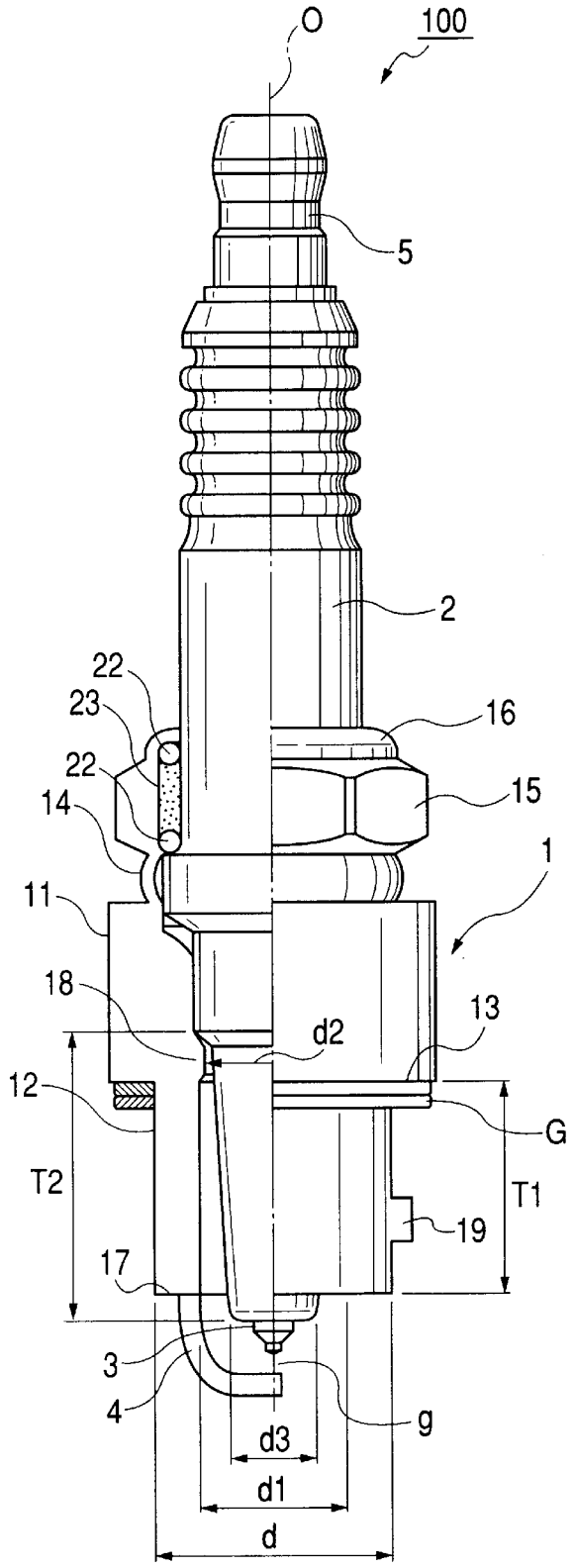
FIG. 1 is a cross-sectional view, partially broken away, of a spark plug as a whole according to an embodiment of the present invention.
Figure 2:
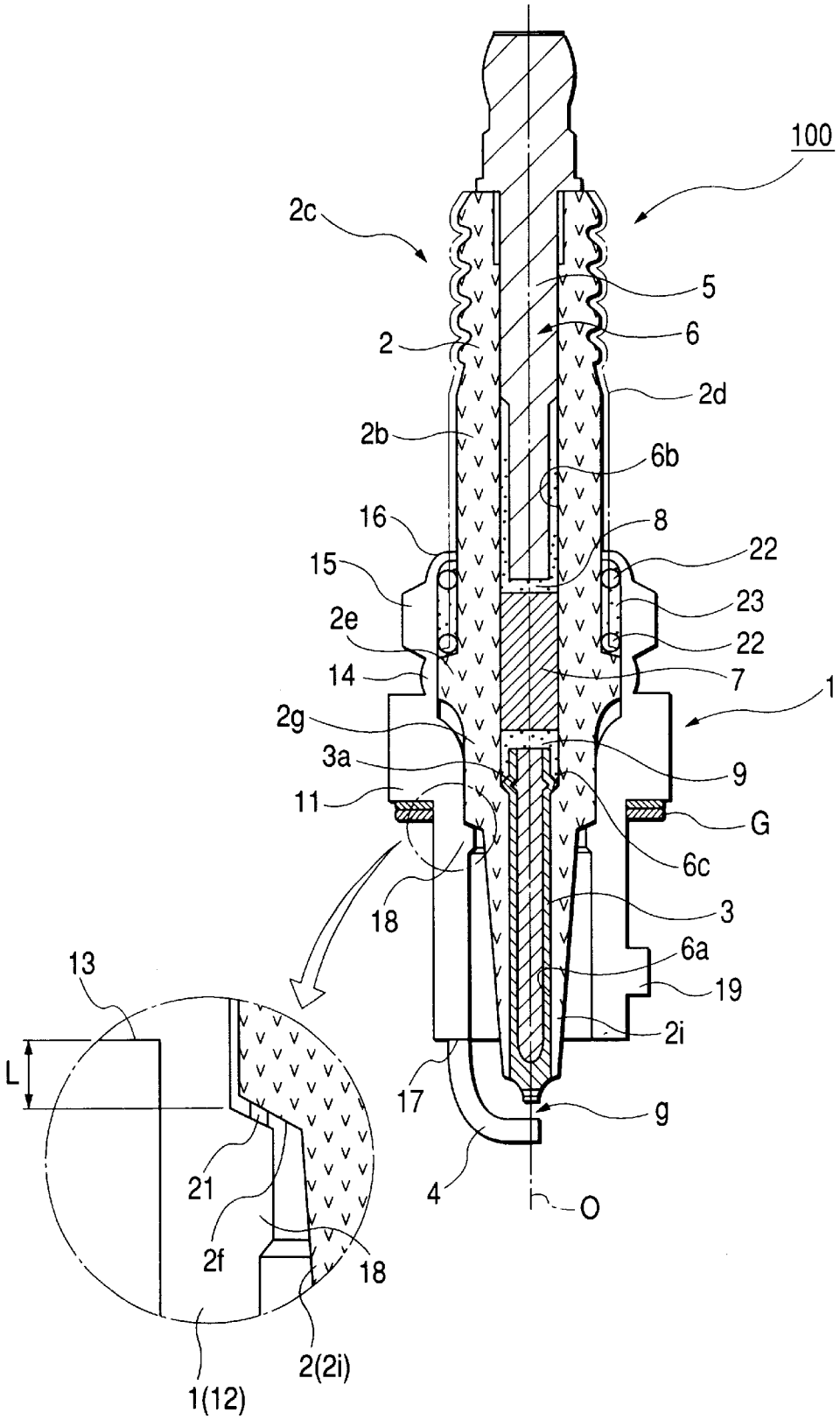
FIG. 2 is a cross-sectional view illustrating the internal structure of the spark plug according to the embodiment of the invention, taken along an axial direction.

FIG. 1 is a cross-sectional view, partially broken away, of the spark plug 100 according to an embodiment of the invention, and FIG. 2 is a cross-sectional view illustrating its internal structure. This spark plug 100 is unipolar type in which an ground electrode 4 is singly formed, and is a flat seal type of providing a seal with a plug bearing surface 13 constituting a plane between a flange portion 11 of a main metal shell 1 and a top end portion 12. Note that the plug bearing surface 13 is fitted with an annular gasket G.

Figure 10:
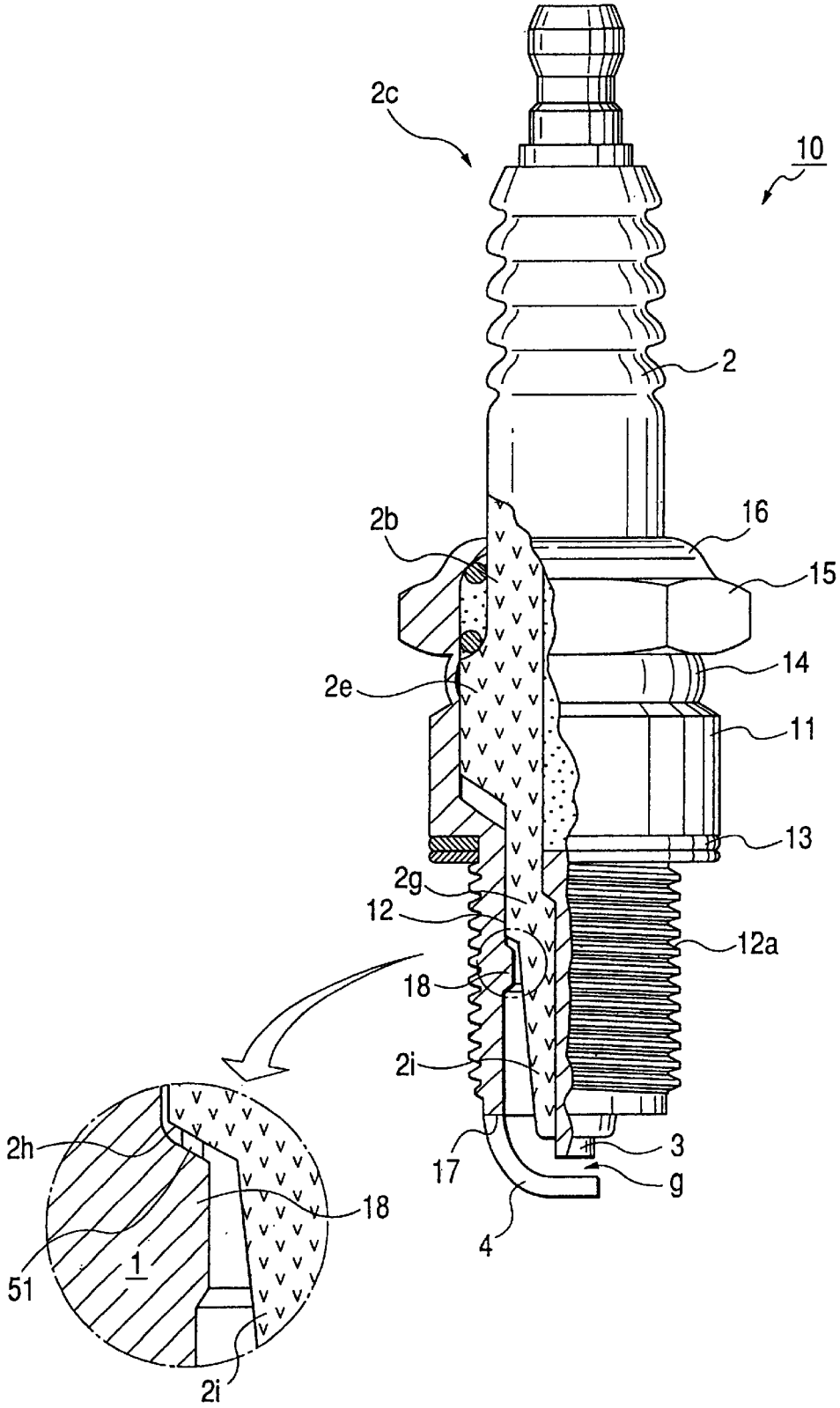
FIG. 10 RELATED ART
FIG. 10 is a cross-sectional view, partially broken away, illustrating the conventional spark plug as a whole.

This spark plug 100 comprises a central electrode 3 extending in an axial direction O, an insulator 2 for surrounding the central electrode 3, and a main metal shell 1 for holding the insulator 2. This main metal shell I is made of carbon steel, and has the flange portion 11 with the plug bearing surface 13 formed on the tip side, and a top end portion 12 extending from this plug bearing surface 13 to the tip side in the axial direction O. This top end portion 12 has no plug attaching external thread on the outer circumference, unlike the conventional spark plug (see FIG. 10), and is made cylindrical. One end of the ground electrode 4 is connected to a top end face of this top end portion 12 to form an ground electrode connecting portion 17. And the other end of this ground electrode 4 is extended to a tip face of the central electrode 3 and opposed to the central electrode 3 via a spark discharge gap g. On the rear end side (base end side) of the flange portion 11, a caulking groove section 14, a hexagonal section 15 and a caulking section 16 are formed in the order from the flange portion 11 to the rear end side. Note that in this specification, the side where the spark discharge gap g is formed is a front side (tip side) in the axial direction O, and the opposite side is a back side (base end side).

The insulator 2 is formed with a through hole 6 in the axial direction O. And a terminal electrode 5 is inserted and secured into the back side of the through hole 6 in the insulator 2, and the central electrode 3 is inserted and secured into the front side of the through hole 6 in the insulator 2. Also, a ceramic resistor 7 (resistor composition made of a mixture of glass powder and conductive material powder and sintered by hot press) is disposed between the terminal electrode 5 and the central electrode 3 in this through hole 6. Both end portions of this ceramic resistor 7 are electrically connected via the conductive glass seal layers 8, 9 to the terminal electrode 5 and the central electrode 3, respectively. Note that the ceramic resistor 7 may be omitted, and the central electrode 3 and the terminal electrode 5 may be directly joined by one conductive glass seal layer.

The insulator 2 has a diameter portion 2*e* protruded circumferentially outward on an almost intermediate section in the axial direction O, as illustrated in detail in FIG. 2. And the insulator 2 has a head portion 2*b* formed in smaller diameter on the rear side than the diameter portion 2*e*. On one hand, a middle trunk portion 2*g* having a smaller diameter than the diameter portion 2*e*, and a leg length portion 2*i* that is further smaller in diameter than the middle trunk portion 2*g* are formed adjacently on the front side of the diameter portion 2*e*. Note that a glaze layer 2*d* is formed on an outer surface of the head portion 2*b*, and a corrugation 2*c* is formed around the outer circumference of the head portion 2*b* on the rear side. Also, an outer face of the leg length portion 2*i* located at the fore-most side of the insulator 2 in the axial direction O is substantially conical with the diameter smaller toward the tip.

The through hole 6 of the insulator 2 has a first portion 6*a* that is almost cylindrical, and a second portion 6*b* that is formed in larger diameter on the rear side than the first portion 6*a*. The terminal electrode 5 and the ceramic resistor 7 are accommodated within this second portion 6*b*, and the central electrode 3 is inserted through the first portion 6*a*. On a base end portion of the central electrode 3, a convex portion 3*a* is formed to protrude outwardly from its outer circumferential face. And the first portion 6*a* and the second portion 6*b* of this through hole 6 are connected with each other within the middle trunk portion 2*g*, and at its connecting position, a convex portion receiving face 6*c* for receiving the convex portion 3*a* of the central electrode 3 is formed like a tapered or R face.

Also, a connecting section between the middle trunk portion 2*g* and the leg length portion 2*i* has a step to form an engagement face 2*h*, which is engaged via an annular plate packing 51 with a metal shell side engaging portion 18 (more particularly, a face for engaging the insulator in the metal shell side engaging portion) protruded inwardly around an inner circumferential face of the main metal shell 1, thereby preventing slippage of the insulator 2 off the tip side in the axial direction O. On the other hand, an annular wire packing 22, a talcum 23 and so forth for engaging the diameter portion 2*e* are disposed between the inner circumferential face of the main metal shell 1 on the rear side and the outer circumferential face of the insulator 2. And the insulator 2 is pushed forward into the main metal shell 1, and in this state, the base end side edge of the main metal shell 1 is caulked inward to the outer face of the insulator 2, employing a caulking tool, to form a caulking portion 16 and allow the insulator 2 to be held against the main metal shell 1.

Herein, this metal shell side engaging portion 18 constitutes a part of a main passage for diffusing a heat flowing into the central electrode 3 and the insulator 2 (leg length portion 2*i*) through the packing 51 and the insulator engagement face 2*h* to the top end portion 12 of the main metal shell 1 and the plug bearing surface 13 to the cylinder head SH. By the way, the distance L (unit: mm) measured from the top end of the plug bearing surface 13 to the base end of the metal shell side engaging portion 18 toward the tip side in the axial direction O is related with the degree of diffusing the heat flowing into the central electrode 3 and the insulator 2, as shown in a balloon view of FIG. 2 (the gasket G is omitted in the balloon view of FIG. 2). On the other hand, in this embodiment, this distance L is set to satisfy the relation, $-6 \leqq L \leqq 6$ (e.g., L=0.5 mm). The measurement results of how the heat resistance of the spark plug changes when the distance L is varied will be described later.

Further, a key projection 19 is projected at one position on the outer circumferential face for the top end portion 12 of the main metal shell 1. And the key projection 19 of this top end portion 12 is fitted with a top end counterpart 36 having a concave key groove 39 adapted to this key projection 19 at one position in a plug hole P formed in the cylinder head SH, as will be described later.

Figure 3A:
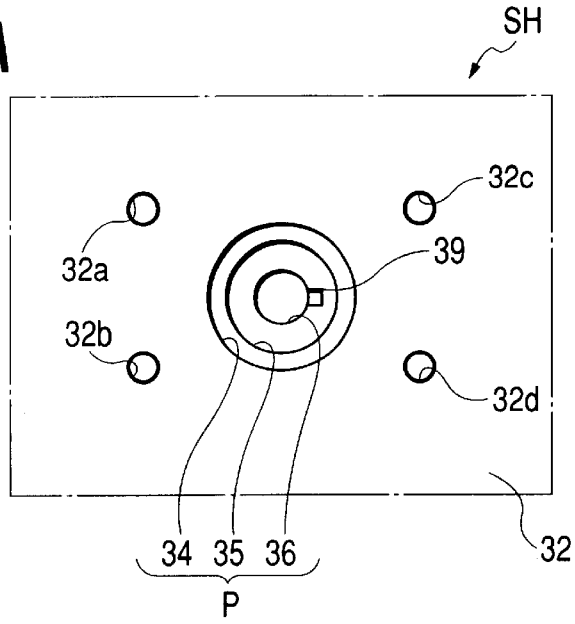
FIG. 3 is a plane view and an axial cross-sectional view illustrating the shape of a cylinder head near a plug hole in this embodiment.
Figure 3B:
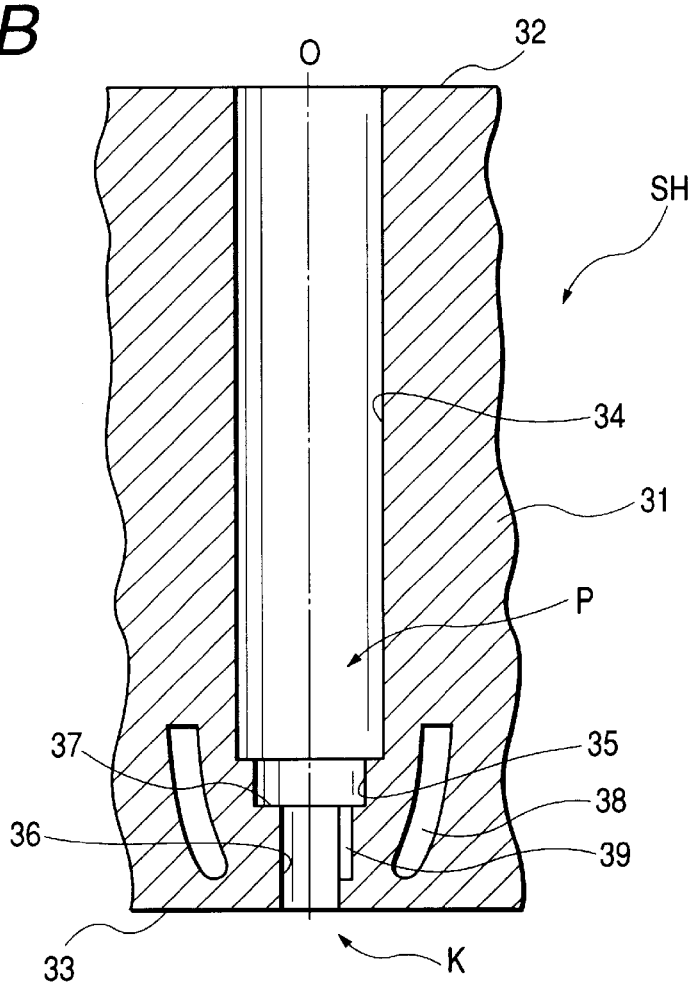

Referring now to FIG. 3, the cylinder head SH according to this embodiment of the invention will be described below. A head main body 31 of the cylinder head SH has the plug hole P penetrating through a head upper face 32 and a combustion chamber face, and further the head upper face 32 around the plug hole P is formed with the screw bores 32*a* to 32*d* for screwing a plug fixture 41, as will be described later. The plug hole P has a depth into which the spark plug 100 is fully inserted, and is composed of a three-step round hole which is smaller in diameter from the head upper face 32.

In particular, an insertion portion 34 on the side of the head upper face 32 is a round hole extending from the head upper face 32 near the combustion chamber face 33, and because it has a larger diameter than the flange portion having the greatest diameter in the main metal shell 1 of the spark plug 100, the spark plug 100 can be inserted with a play. And the top end counterpart 36 on the side of the combustion chamber face 33 is one into which the top end portion 12 of the main metal shell 1 is inserted with a play, when the spark plug 100 is inserted. Also, the flange counterpart 35 is located between the insertion portion 34 and the top end counterpart 36, and constitutes a part into which the flange portion 11 of the main metal shell 1 is inserted with a play, when the spark plug 100 is inserted. Note that a seal face 37 at the boundary portion between the flange counterpart 35 and the top end counterpart 36 is abutted against the gasket G attached on the spark plug 100 to serve as a seal. Further, this top end counterpart 36 is formed with a key groove 39 in width and depth adaptive to the key projection 19 of the spark plug 100, as will be apparent from FIG. 3A. Also, the cylinder head SH is formed with a circulation hole 38 for circulating the coolant.

In this embodiment, the key groove 39 of the plug hole P and the key projection 19 of the main metal shell 1 constituting the spark plug 100 are formed in the specific positional relation in the light of a position where the ground electrode connecting portion 17 is formed. By the way, it is known that the ignition of a fuel-air mixture may vary in easiness depending on the relation between the flow direction of a swirl arising at the compression stroke within the combustion chamber and the position where the ground electrode 4 is disposed within the combustion chamber. That is, in the case where the ground electrode 4 prevents the swirl from flowing into the spark discharge gap g, because the swirl is hard to flow into the spark discharge gap g, the fuel-air mixture can be only ignited at relatively rich ratio of fuel.

Figure 11:
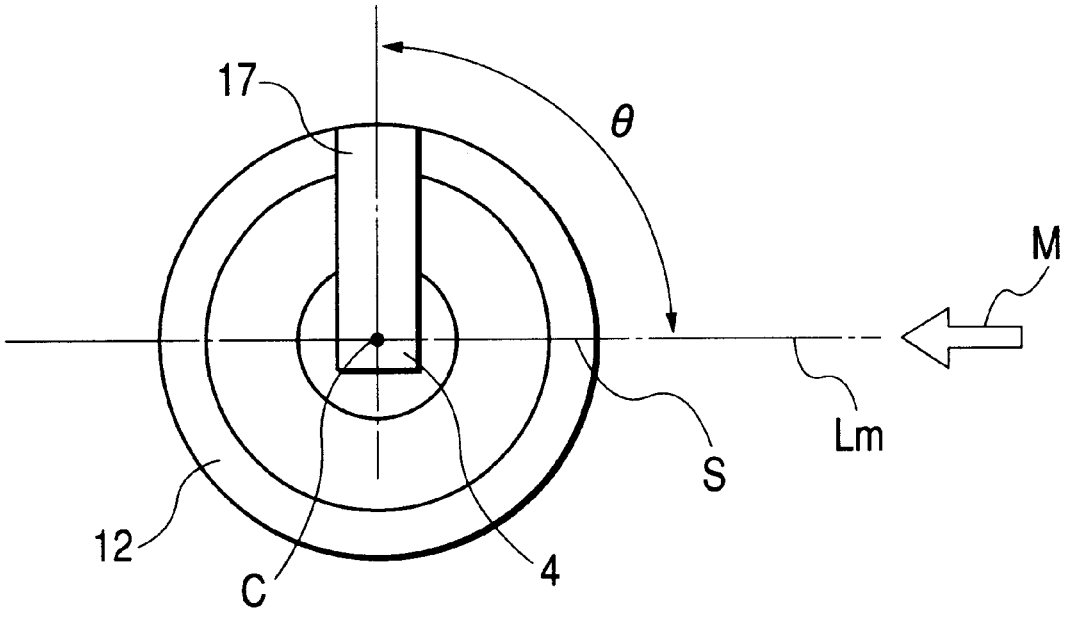
FIG. 11 is an explanatory view for explaining the relation between the position of an ground electrode disposed in the spark plug and the flow direction of a swirl.

On the other hand, in this embodiment, when the spark plug 100 is mounted in the plug hole P, the formation position of the ground electrode connecting portion 11 and the formation position of the key projection 19 in the top end portion 12, and further the formation position of the key projection 19 and the formation position of the key groove 39 in the top end counterpart 36 are defined in the specific positional relation, so that the swirl flow direction and the arranged position of the ground electrode 4 within the combustion chamber may satisfy the optimal positional relation. As referred herein, the optimal positional relation between the swirl flow direction and the arranged position of the ground electrode 4 within the combustion chamber means that in the spark plug 100 of unipolar type, the ground electrode 4 is not arranged upstream or downstream in the swirl flow direction, and the circumferential position of the ground electrode connecting portion 17 has an angle θ of 90° with reference to a point of intersection S on the upstream side, of the points of intersection between the stream line Lm of swirl M passing through the center C of the top end portion 12 and the outer circumferential face of the top end portion 12, as viewed from the tip side of the spark plug 100 in the axial direction O, as shown in FIG. 11.

Figure 4:
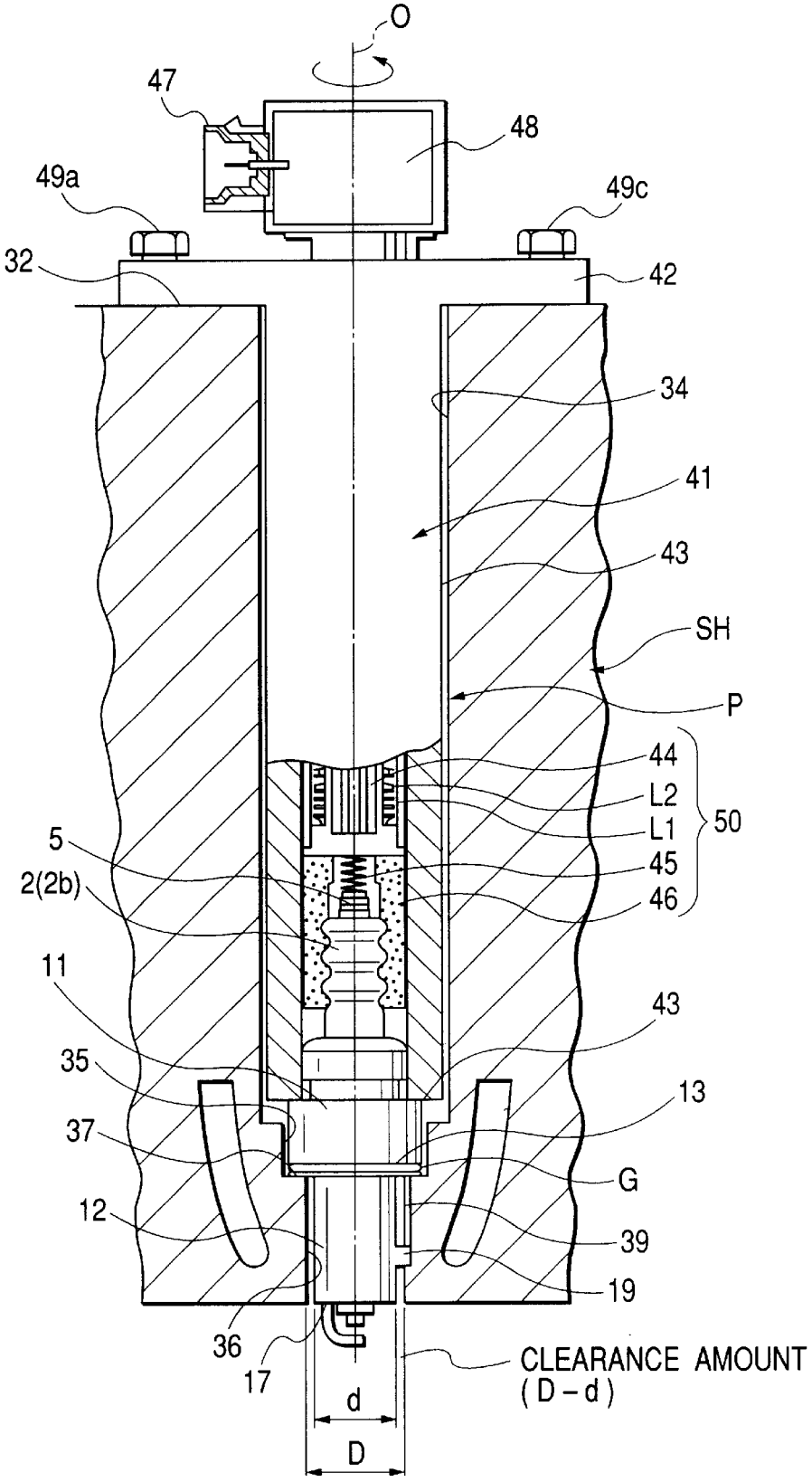
FIG. 4 is an explanatory view (cross-sectional view, partially broken away) illustrating a mounting structure of the spark plug in a state where the spark plug as shown in FIG. 1 (FIG. 2) is inserted into the plug hole of the cylinder head as shown in FIG. 3 and fitted together.

Referring now to FIG. 4, the plug fixture 41 according to this embodiment will be described below. The plug fixture 41 comprises a projection portion 42, made of metal (aluminum), for securing itself to the cylinder head SH, and a barrel portion 43 that has an almost cylindrical shape. The projection portion 42 is formed with a plurality of mounting holes at the respective positions corresponding to a plurality of screw holes 32*a* to 32*d* of the cylinder head SH, not shown. Also, the barrel portion 43 has its outer circumferential face having a slightly smaller diameter than the insertion portion 34 of the cylinder head SH, and a top end face 43*a* at its tip has its inner circumferential face of a larger diameter than the hexagonal portion 15 to allow the base end face of the flange portion 11 of the main metal shell 1 constituting the spark plug 100 to be pressed, as will be described later.

And this barrel portion 43 accommodates internally an ignition coil portion 50 composed of a coil core 44, a primary winding L1 and a secondary winding L2, and a connection terminal 45 for supplying a high voltage for discharge generated at the secondary winding L2 to the terminal electrode 5 of the spark plug 100, as shown in FIG. 4. A secondary bobbin with the secondary winding L2 wound is disposed around the coil core 44, and further a primary bobbin with the primary winding L1 wound is disposed around the secondary bobbin. Also, inside the barrel portion 43, an insulative holding member 46 made of heat resistant rubber and coming into contact with the head portion 2*b* of the insulator 2 constituting the spark plug 100 is provided to cover the connection terminal. Further, the connection terminal 45 like a spring that is electrically connected to one end of the secondary winding L2 is brought into contact with the terminal electrode 5 in a form compressed in the axial direction O, to effect electrical connection between them (see FIG. 4). At this time, the insulative holding member 47 comes into contact with the head portion 2*b* of the insulator 2, and fulfills a function of securing the insulation between the ignition coil portion 50 and the spark plug 100.

In this way, the plug fixture 41 in this embodiment contains the ignition coil portion 50, which can be placed within the plug hole P at the same time when the spark plug 100 is secured in the plug hole P by means of the plug fixture 41, as will be described later, and further the plug fixture 41 can complete the connection between the spark plug 100 and the ignition coil portion 50. Also, when the plug fixture 42 is employed, the spark plug is directly connected with the ignition coil portion 50, whereby there is no need of providing the high tension cable for connecting them to reduce the noise that may occur. This plug fixture 41 is provided with a connector portion 47 and an ignition unit 48 for effecting connection with an external device such as a power supply unit or the ECU, because it has internally the ignition coil 50. This ignition unit 48 contains a switching element (not shown) for conducting or cutting off the current (primary current) supplied from the power supply unit to the primary winding L1, on the basis of an ignition instruction signal output from the ECU. Note that this ignition unit 48 is electrically connected to the connector portion 47 and to the ignition coil portion 50.

Then, the spark plug 100 and the plug fixture 41 are mounted on the cylinder head SH. Firstly, the spark plug 100 is inserted into the plug hole P of the cylinder head SH with a play, as shown in FIG. 4. At this time, the spark plug 100 is inserted into the plug hole while being rotated in the axial direction O, so that the key projection 19 formed at the top end portion 12 of the main metal shell 1 is fitted into the key groove 39 formed in the tip side counterpart 36 of the plug hole P, whereby the spark plug 100 is mounted in the plug hole P. That is, the top end portion 12 of the main metal shell 1 and the top end counterpart 36 of the plug hole P are fitted with each other by means of the key projection 19 and the key groove 39. Thereby, the gasket G is abutted against the seal face 37.

Further, employing the plug fixture 41, the spark plug 100 is fixed to the cylinder head SH. Firstly, the barrel portion 43 of the plug fixture 41 is inserted into the plug hole P, as shown in FIG. 4. The outer circumferential face of the barrel portion 43, which has a slightly smaller diameter than the insertion portion 34, can be inserted with a play, so that the top end face 43*a* of the barrel portion 43 is brought into contact with the rear end face located opposite to the plug bearing surface 13 of the flange portion 11 of the main metal shell 1. At this time, inside the barrel portion 43, the connection terminal 45 comes into contact with the terminal electrode 5 of the spark plug 100 under pressure.

Figure 5:
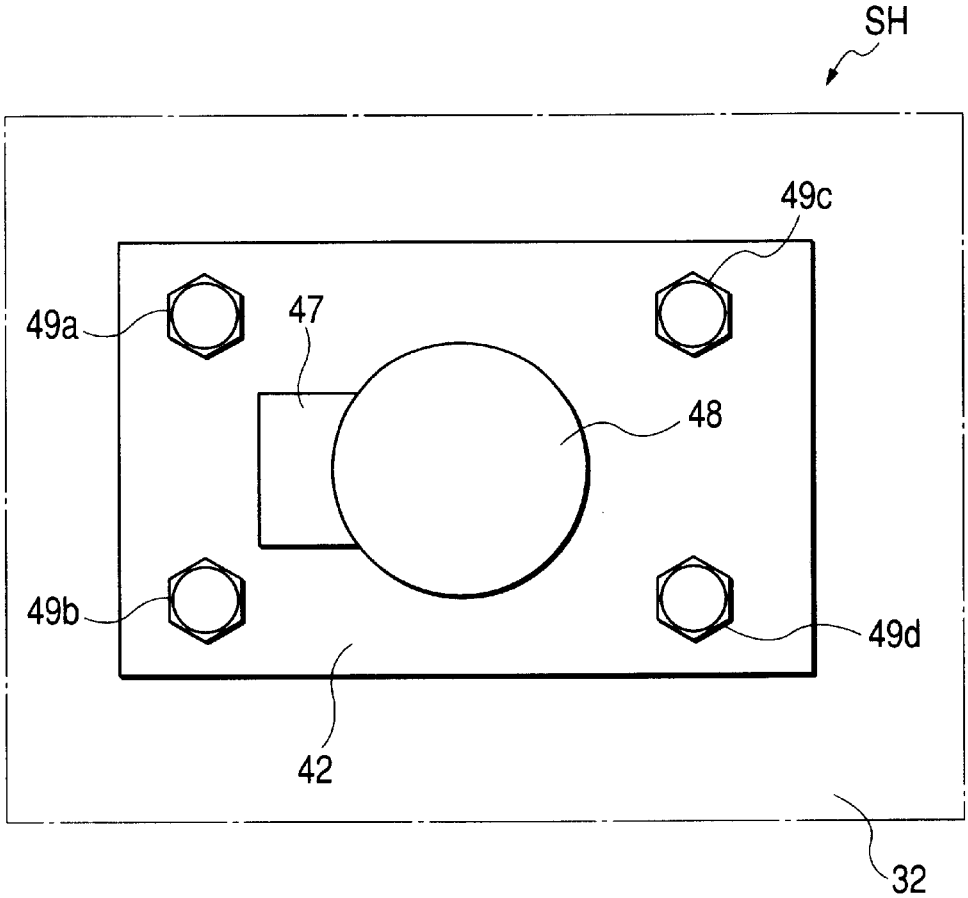
FIG. 5 is a plane view illustrating a state where the spark plug as shown in FIG. 1 (FIG. 2) is inserted into the plug hole of the cylinder head as shown in FIG. 3 and fitted together.

Then, the projection portion 42 of the plug fixture 41 is aligned so that the plurality of mounting holes are adapted with the screw holes 32*a* to 32*d*, and the plug fixture 41 is screwed into the head upper face 32 of the cylinder head SH, employing the bolts 49*a* to 49*d*, as shown in FIGS. 4 and 5. Thereby, there occurs an urging force toward the tip side in the axial direction O on the barrel portion 43 coming into contact with the rear end face of the flange portion 11 of the main metal shell 1, so that the plug bearing surface 13 of the flange portion 11 is urged against the cylinder head SH, whereby the seal between the plug bearing surface 13 and the seal face 37 can be made via the gasket G. And by fixing the plug fixture 41 to the cylinder head SH, the spark plug 100 having the main metal shell 1 without an external thread for attaching the spark plug is fixed to the cylinder head SH. Note that the length (height) of the barrel portion 42 should be suitably adjusted in view of the size of the spark plug 100 or the plug hole P so as to press the spark plug at an appropriate pressure.

In this way, the spark plug 100 is mounted in the cylinder head SH (plug hole P), but in this embodiment, with its mounting structure, assuming that the outer diameter of the top end portion 12 in the main metal shell 1 is $\phi d$ (unit: mm), and the hole diameter of the top end counterpart 36 in the plug hole P is $\phi D$ (unit: mm), the clearance amount ($\phi D-\phi d$) is set to satisfy the relation $\phi D-\phi d \leqq 0.15$, as shown in FIG. 4. The hole diameter $\phi D$ of the top end counterpart 36 in the plug hole P may be different for each design of the cylinder head SH, and the outer diameter $\phi d$ of the top end portion 12 is determined to satisfy the above range (relation) for any plug hole P. In this embodiment, the hole diameter $\phi D$ is equal to 13.70 mm, and the outer diameter $\phi d$ is equal to 13.60 mm, and the clearance amount $\phi D-\phi d$ is equal to 0.10 mm, for examples In this way, if the clearance amount ($\phi D-\phi d$) is set at 0.15 mm or less, a heat flowing from the insulator 2, the central electrode 3 and the ground electrode 4 into the top end portion 12 of the main metal shell 1 can be diffused into the cylinder head SH rapidly. As a result, the central electrode 3, the insulator 2 and the ground electrode 4 are maintained at low temperatures, providing the heat resistance equivalent or superior to that of the spark plug having the external thread formed in the top end portion 12, whereby there is no risk that the spark plug 100 causes a failure of preignition or melting the electrode Further, the relation between the swirl flow direction and the ground electrode 4 will be considered in a state where the spark plug 100 is mounted in the cylinder head SH, as described above. Herein, in this embodiment, the formation position of the ground electrode connecting portion 17 and the formation position of the key projection 19 and the key groove 39 have the predetermined positional relations, so that the optimal positional relation may be satisfied between the swirl flow direction and the ground electrode connecting portion 17, when the spark plug 100 is mounted in the cylinder head SH. Accordingly, when the spark plug 100 is mounted in the cylinder head SH, the ground electrode connecting portion 17 is always restricted at the specific position. Accordingly, the position where the ground electrode 4 is disposed within the combustion chamber is set not to impede the flow of swirl, whereby the fuel-air mixture can be ignited securely by a spark discharge arising at the spark discharge gap g. Further, by any combination of the spark plug with the same parts number and the cylinder head, the internal combustion engine can be always driven at lean air fuel ratio, and the fuel consumption can be improved.

The present invention has been described in connection with the embodiment, but the invention is not limited to the above embodiment, and may be varied or modified appropriately without departing from the scope or spirit of the invention. For example, in the above embodiment, the spark plug 100 is of unipolar type in which one ground electrode 4 is connected to the main metal shell, but may be of multipolar type in which a plurality of ground electrodes 4 are connected to the main metal shell 1. Also, the main metal shell 1 is made of carbon steel as a formation material, but the main metal shell 1 may be formed of copper alloy or aluminum alloy that is superior in the heat conductivity than carbon steel to enhance the diffusion of heat flowing in from the insulator 2, the central electrode 3 and the ground electrode 4.

Figure 6A:
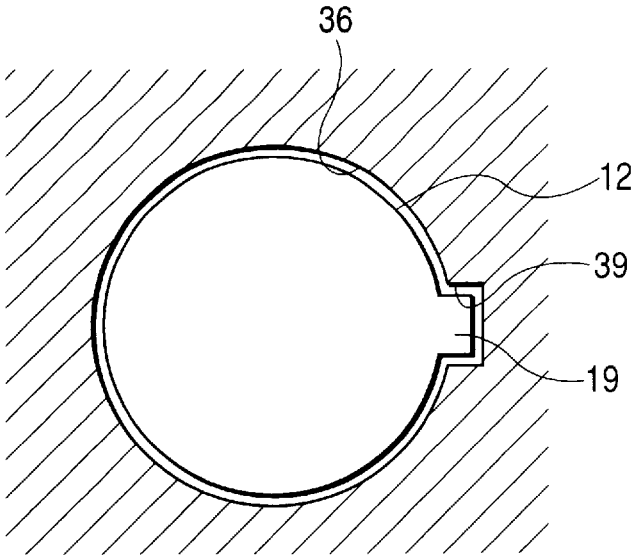
FIG. 6 is an explanatory view illustrating an example of a fitting position restricting shape for enabling a top end portion of a main metal shell and a top end counterpart of the plug hole to be fitted together.
Figure 6B:
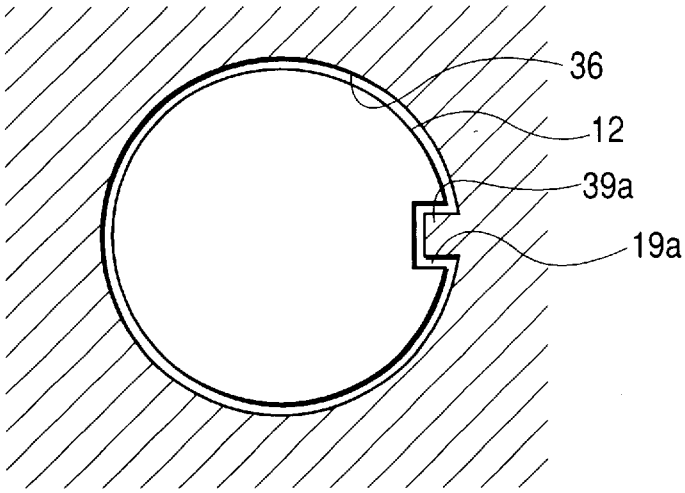

Further, in the above embodiment, the convex key projection 19 is formed at the top end portion 12 of the main metal shell 1 constituting the spark plug 100, and the concave key groove 39 is formed in the top end counterpart 36 of the plug hole P, both being engaged with each other only at one position, as shown in FIG. 6A, whereas the fitting position restriction shape may take other configuration. For example, a concave key groove 19*a* may be provided at the top end portion 12 of the main metal shell 1, and a convex key projection 39*a* may be provided in the top end counterpart 36 of the plug hole P, both being fitted together, as shown in FIG. 6B, by contrast with FIG. 6A.

Figure 7A:
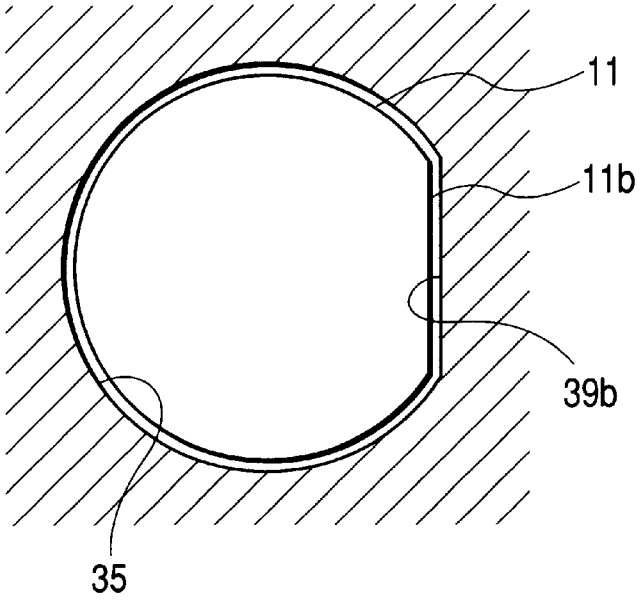
FIG. 7 is an explanatory view illustrating another example of the fitting position restricting shape for enabling a flange portion of the main metal shell and a flange counterpart of the plug hole to be fitted together.
Figure 7B:
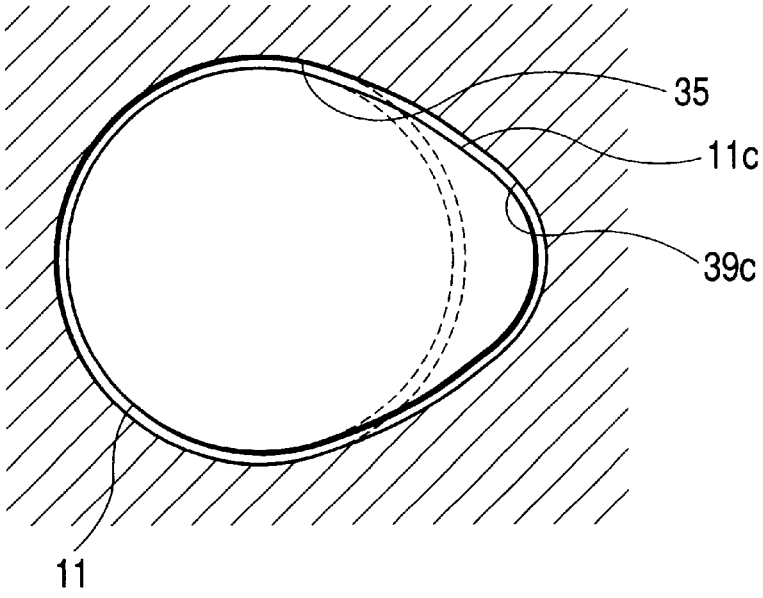

In FIG. 7A, the flange portion 11 in the main metal shell 1 is partially beveled on an outer circumferential lateral face to provide a flat plane 19*b*, and the flange counterpart 11 of the plug hole P is formed with a flat plane 39*b* corresponding to the shape of the flat plane 19*a*, both flat planes being fitted together. Also, in FIG. 7B, the flange portion 11 is not circular, but made almost oval in cross section with an enlarged diameter portion 19*c* budging out of the circle as indicated by the broken line, and the flange counterpart 35 of the plug hole P is provided with an enlarged diameter portion 39*c* corresponding to the enlarged diameter portion 19*c*, both being fitted together.

And in any shape, the top end portion 12 of the main metal shell 1 and the top end counterpart 36 of the plug hole P, or the flange portion 11 of the main metal shell 1 and the flange counterpart 35 of the plug hole P are fitted at only one position. Accordingly, if the positional relation between the fitting position restriction shape and the ground electrode connecting portion 17 in the spark plug 100 is limited in the light of the swirl flow direction, the spark plug 100 is inserted and fitted into the plug hole P with a play, so that the ground electrode 4 can be disposed at a specific position within the combustion chamber at any time.

Figure 12:
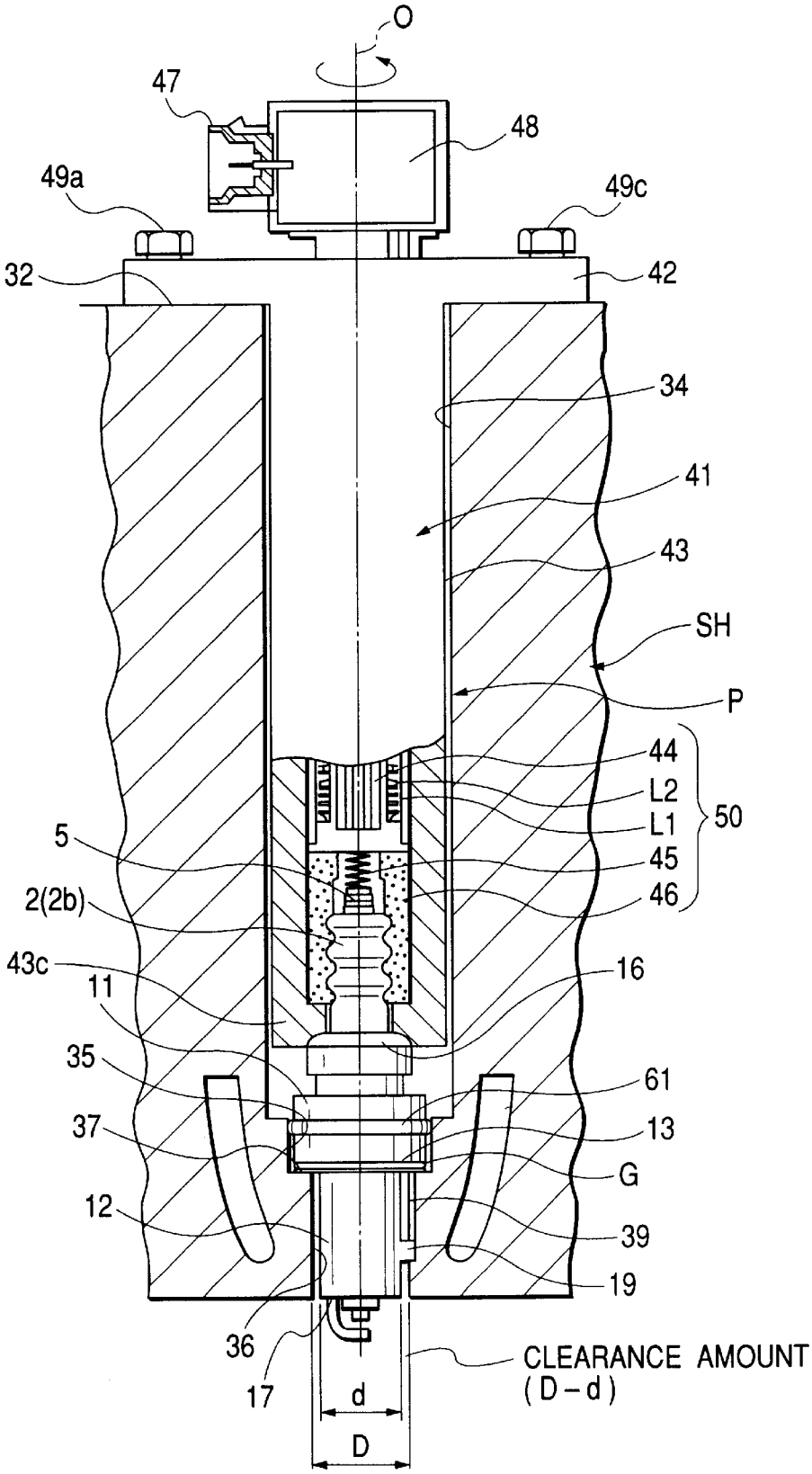
FIG. 12 is an explanatory view for explaining a mounting structure according to another embodiment of the invention that is different from the mounting structure of the spark plug as shown in FIG. 4.

In the above embodiment, the top end face 43*a* of the barrel portion 43 in the plug fixture 41 is brought into contact with the rear end face of the flange portion 11 in the main metal shell 1, with an urging force caused by fixation with the plug fixture 41 being exerted on the rear end face to urge the plug bearing surface 13 toward the cylinder head SH, as shown in FIG. 4. However, the top end portion 43*c* of the barrel portion 43 may be shaped to make contact with the caulking portion 16 of the main metal shell 1, and the spark plug 100 may be fixed to the cylinder head SH, employing the plug fixture 41, as shown in FIG. 12. Also in this structure, the top end portion 43*c* of the barrel portion 43 in the plug fixture 41 is brought into contact with the caulking portion 16 of the main metal shell 1, and an urging force toward the tip side in the axial direction O that is caused by fixing the plug fixture to the cylinder head SH is exerted on the caulking portion 16 of the main metal shell 1 to urge the plug bearing surface 13 toward the cylinder head SH.

Further, in addition to the structure of the spark plug 100 in the above embodiment, a concave portion with bottom (not shown) may be provided on the outer circumferential lateral face of the flange portion 11 in the main metal shell 1 circumferentially, with an annular elastic member 61 (e.g., rubber) capable of elastic deformation being fitted in the concave portion, as shown in FIG. 12. This spark plug 100 is completely sealed between the flange portion 11 and the inner wall (flange counterpart 35) of the plug hole P by the elastic member 61, after being mounted on the cylinder head SH, improving the air-tightness between the spark plug 100 and the cylinder head SH.

EXAMPLE 1

In order to make sure of the effects of the present invention, the heat resistance of the spark plug 100 was estimated by changing the outer diameter ϕd of the top end portion 12 in the main metal shell 12 as shown in FIG. 1 (or FIG. 4), with the hole diameter ϕD of the top end counterpart 36 of the plug hole P kept constant (13.7 mm), and changing the clearance amount (ϕD−ϕd). In the spark plug 100, the axial O length T1 of the top end portion 12 was set to 15.0 mm, the inner diameter ϕd1 of the top end portion 12 to 8.4 mm, and the minimum inner diameter ϕd2 of the metal shell engaging portion 18 to 7.5 mm (see FIG. 1) for the estimation. Also, the distance L measured from the top end side edge of the plug bearing surface 13 to the base end side edge of the metal shell engaging portion 18 toward the tip in the axial direction O was set to 0 mm (see FIG. 2). Further, for this estimation, the distance T2 of the leg length portion 2*i* of the insulator 2 in the axial direction O was set to 14 mm (the tip outer diameter ϕd3 of the leg length portion 2*i* being 5.1 mm) and to 17 mm (the tip outer diameter ϕd3 of the leg length portion 2*i* being 5.1 mm) (see FIG. 1).

Figure 8:
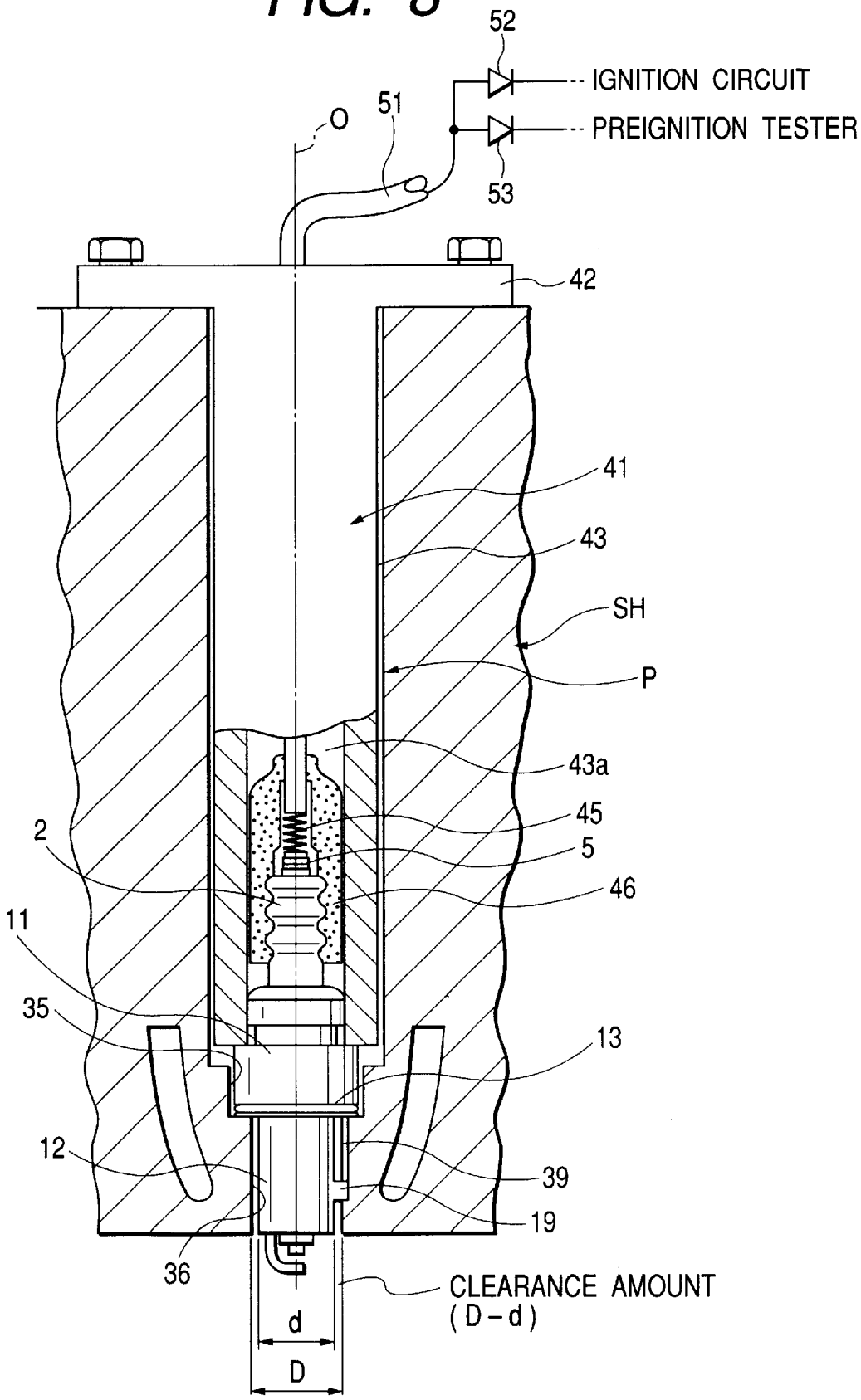
FIG. 8 is an explanatory view illustrating how a preignition test of the spark plug (a mounting structure of the spark plug) according to this embodiment is conducted.

Herein, the heat resistance of the spark plug 100 was estimated in accordance with the following method. As shown in FIG. 8, the spark plug 100 was fixed to the cylinder head SH by means of the plug fixture 41 with the ignition coil portion 50 and the projection portion 42 removed centrally. This plug fixture 41 having the projection portion 42 formed with the through hole 43*b* leading to the inner circumferential face of the barrel portion 43 fixes the spark plug 100, in which by inserting the insulative holding member 46 having internally the connection terminal 45 connected to the cable 51 through this through hole 43*b*, the connection terminal 45 and the terminal electrode 5 of the spark plug 100 are brought into contact with each other under pressure. This cable 51 is connected via a high voltage resistant diode 52 to an ignition circuit, not shown, and via a high voltage resistant diode 53 to a preignition tester, not shown.

This preignition tester measures what is called an ion current. That is, when a preignition arises, if the spark discharge gap g is caught by flames, the spark discharge gap becomes conductive due to ions in the flames. Accordingly, if a voltage of several hundreds volts is applied beforehand across the spark discharge gap g, an ion current flows when preignition arises. Thus, if the ion current is detected before discharging the ions in the ignition circuit, it can be found that preignition has arisen.

After the spark plug 100 was fixed to the cylinder head SH, as described above, the internal combustion engine (1600 cc, inline 4, throttle full open) was driven and maintained for two minutes while the angular advance was changed by every one degree from the normal ignition time, in which it was measured whether or not a preignition arose for that period, and the angular advance at which the preignition arose for the first time was determined. The relation between each clearance amount (ϕD−ϕd) and the angular advance is shown in a graph of FIG. 9.

In making this estimation, the conventional spark plug (see FIG. 10) with the external thread (M14S) formed around the top end portion of the main metal shell was estimated in the same manner for two kinds of spark plug with the distance T2 of the leg length portion being 14 mm and 17 mm (the distance L measured from the top end side edge of the plug bearing surface to the base end side edge of the metal shell side engaging portion toward the tip in the axial direction was assumed to be 0 mm). And for the conventional spark plug, with the distance T2 of the leg length portion being 14 mm, the angular advance at which the preignition arose was 20 degrees, and for that with the distance T2 of the leg length portion being 17 mm, the angular advance at which the preignition arose was 15 degrees.

Figure 9:
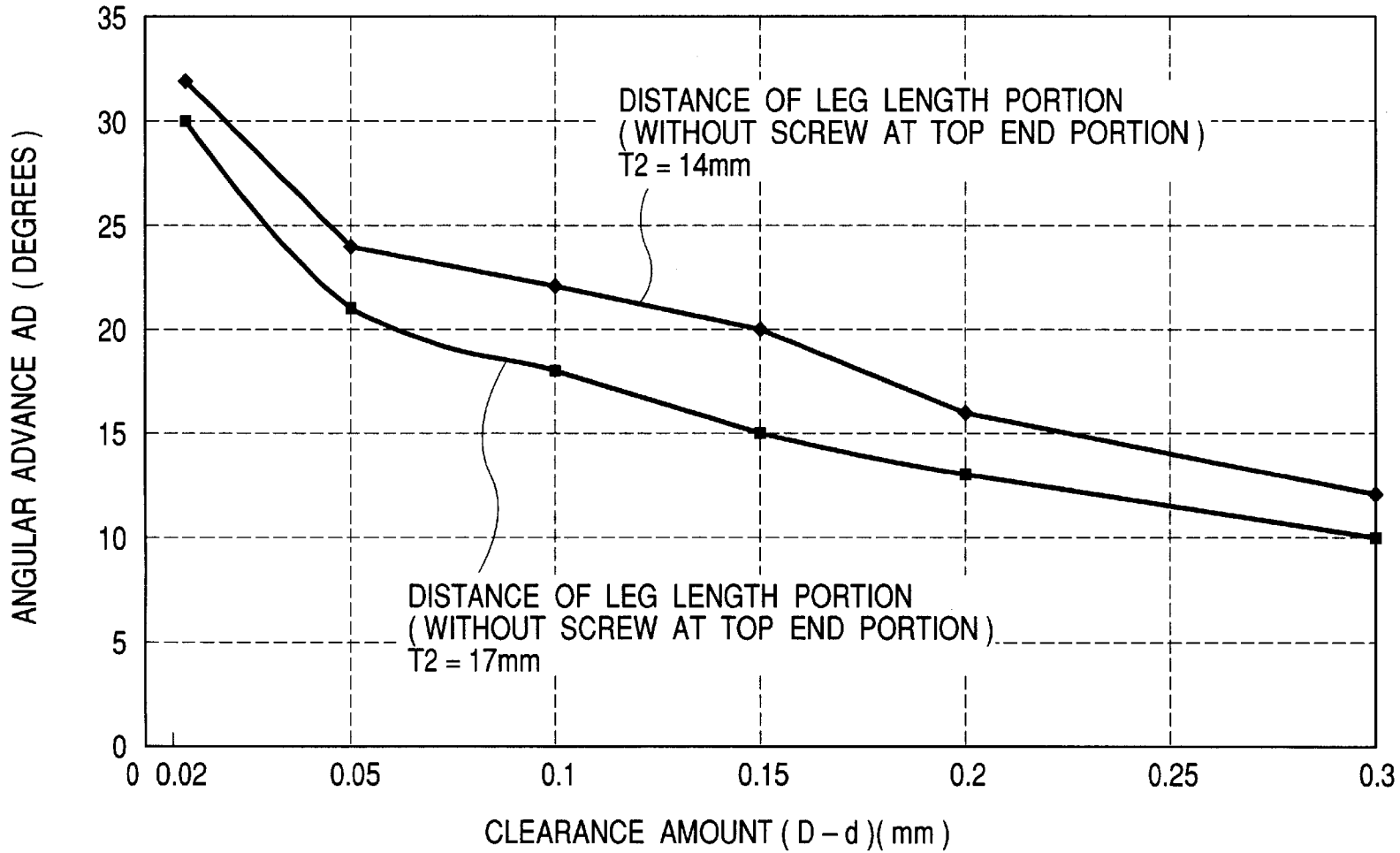
FIG. 9 is a graphical representation showing the results of the preignition test of FIG. 8 conducted by varying the clearance amount (ϕD−ϕd) in the mounting structure of the spark plug as shown in FIG. 4.

On the other hand, for the spark plug 100 of this embodiment, it could be found that with the clearance amount (φD−φd)=0.15 mm, the internal combustion engine was driven without causing preignition up to the angular advance equivalent to that of the conventional example as above for two kinds of spark plug with the distance T2 of the leg length portion 2*i* being 14 mm and 17 mm, as will be seen from the graph of FIG. 9. Also, it could be found that with the clearance amount (φD−φd)=0.02 mm, 0.05 mm and 0.10 mm, it was driven without preignition up to the angular advance beyond that of the conventional example for two kinds of spark plug with the distance T2 of the leg length portion 2*i* being 14 mm and 17 mm, improving the heat resistance. On the other hand, beyond the clearance amount (φD−φd)=0.15 mm, it was found that the heat resistance was inferior to that of the conventional example for two kinds of spark plug with the distance T2 of the leg length portion 2*i* being 14 mm and 17 mm.

EXAMPLE 2

The spark plugs of this embodiment employed in the example 1, with the distance T2 of the leg length portion 2*i* being 17 mm and the clearance amount (φD−φd) 0.05 mm, were prepared for five kinds with the distance L measured from the top end side edge of the plug bearing surface 13 to the base end side edge of the metal shell side engaging portion 18 toward the tip in the axial direction O being −6.5 mm, −3.0 mm, ±0 mm (corresponding to the example 1), 3.0 mm and 6.0 mm, and the heat resistance of the spark plugs 100 was estimated in accordance with the same method of the example 1.

The angular advance at which the preignition arose in the spark plug when the distance L was changed in five ways was 16 degrees for the distance L of −6.5 mm, 20 degrees for −3.0 mm, 21 degrees for ±0 mm, 20 degrees for 3.0 mm, and 18 degrees for 6.0 mm. From these results, for four kinds of spark plugs satisfying the relation −6 mm≦L≦6 mm for the distance L, it was found that the heat resistance was improved over the spark plug with the distance L of −6.5 mm that is below the distance L=−6 mm.

In the above examples 1 and 2 of the invention, the spark plug 1 and the ignition coil portion 50 are formed separately, and mounted by inserting each of them into the plug hole P. However, this invention is also applicable to the coil integral-type spark plug having the spark plug and the ignition coil portion formed integrally in unrotatable way.

EXAMPLE 3

An example 3 of the invention will be described below in conjunction with the drawings.

Figure 13:
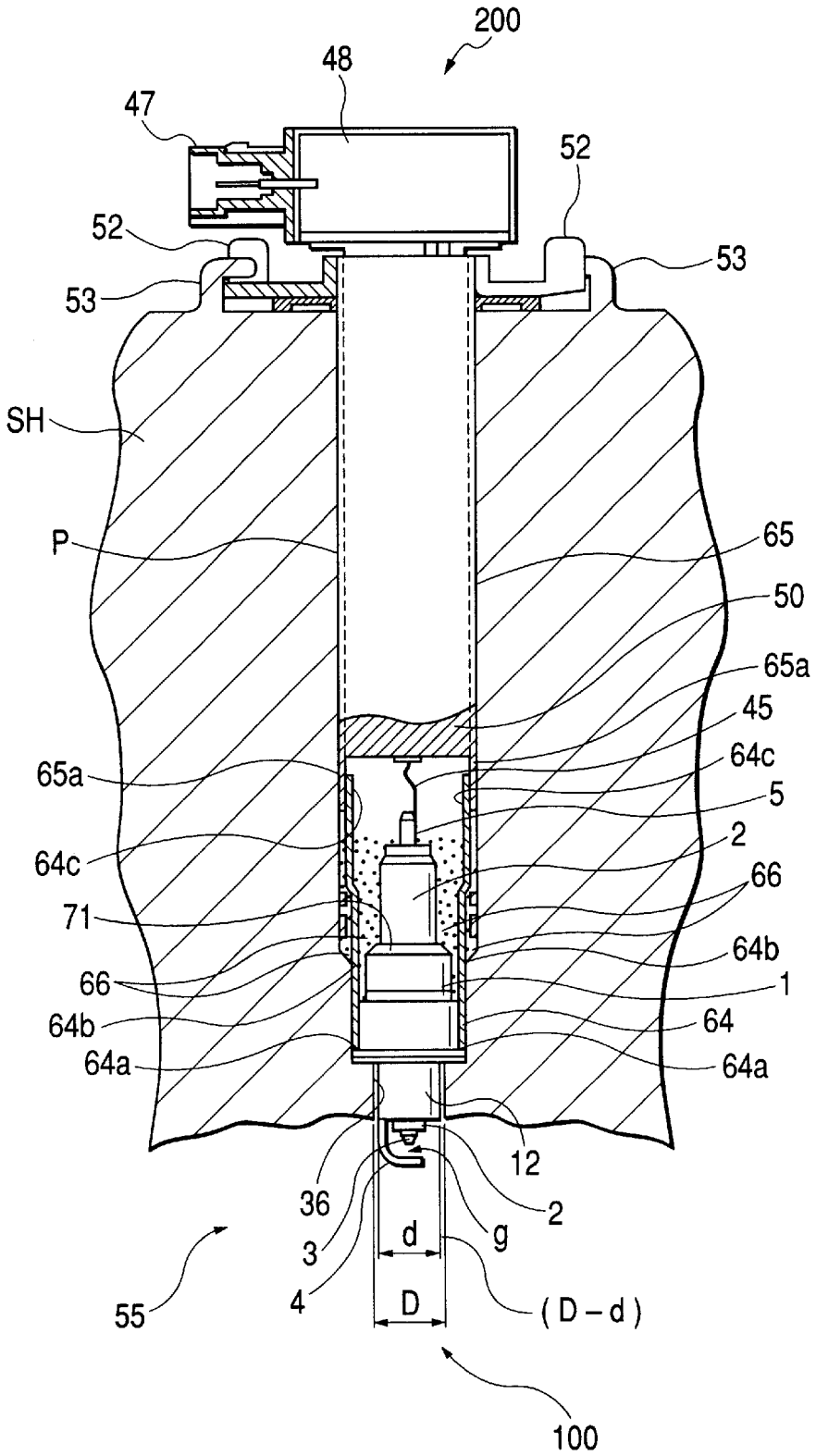
FIG. 13 is an outer view showing the appearance of a coil integral-type spark plug 200 of an example 3, partially in cross section.

FIG. 13 is an explanatory view showing the outer shape, partially in cross section, of a coil integral-type spark plug 200 of this example.

As shown in FIG. 13, the coil integral-type spark plug 200 comprises a spark plug 100 for producing a spark discharge at a spark discharge gap g formed between a center electrode 3 and an ground electrode 4, an ignition coil portion 50 for generating a high voltage for ignition to produce a spark discharge at the spark plug 100, a first barrel portion 64 of cylindrical shape with a first overlapping portion 64*a* fixed to a main metal shell 1 of the spark plug 100, a second barrel portion 65 of cylindrical shape that is formed in larger diameter than the first barrel portion 64 for accommodating the ignition coil portion 50 internally, and an ignition unit 48 for conducting or shutting off the electricity into the ignition coil portion 50 upon an instruction from the outside, in which the spark plug 100 and the ignition coil portion 50 are integrally formed.

And in FIG. 13, the ignition coil portion 50 comprises a primary winding L1 and a secondary winding L2, not shown, in which the primary winding has one end connected to a switching element provided in the ignition unit 48, the other end being connected to a terminal of a connector portion 47 provided in the ignition unit 48. This terminal in the connector portion 47 is connected to a power source unit (battery) provided externally. Further, the secondary winding L2 has one end connected to a connection terminal 45 for output a high voltage for ignition, this connection terminal 45 being connected to a terminal electrode 5 of the spark plug 100, with the other end being connected to a terminal of the connector portion 47 provided in the ignition unit 48. This terminal in the connector portion 47 is connected (grounded) to the ground line provided externally.

Then, the barrel portion of cylindrical shape for accommodating the ignition coil portion 50 inside, which is integrated with the main metal shell 1 of the spark plug 100 to be unrotatable in the axial direction O, has a dual structure having a first barrel portion 64 and a second barrel portion 65 that are disposed adjacently in the axial direction O, shown in FIG. 3.

The first barrel portion 64 is disposed for the main metal shell 1 of the spark plug 100 to produce the first overlapping portion 64*a*, and in this first overlapping portion 64*a*, both the main metal shell 1 and the first barrel portion 64 are integrated to be unrotatable in the axial direction O by laser welding. A filler hole 64*b* is provided on a side face of this first barrel portion 64. This filler hole 64*b* is employed as an inlet for filling the resin or rubber having insulating property into the inside of the first barrel portion 64, after the first barrel portion and the second barrel portion are integrated, as will be described later.

On the other hand, the second barrel portion 65 is disposed to produce a second overlapping portion 64*c* with respect to a base end portion of the first barrel portion 64 on an inner circumferential face of a top end portion 65*a* of its own, and in the second overlapping portion 64*c*, both the first barrel portion 64 and the second barrel portion 65 are integrated to be unrotatable in the axial direction O.

Means for integrating the first overlapping portion 64*a* and the second overlapping portion 64*a* is not limited to laser welding, but may be the electron beam welding, or ring resistance welding.

The material for the first barrel portion 64 and the second barrel portion 65 is desirably metal. Specifically, it is desirable that the first barrel portion 64 is made of a paramagnetic material such as stainless, and the second barrel portion 65 is made of a ferromagnetic material such as iron. The reason is as follows. The second barrel portion 65 accommodates the ignition coil portion 50 inside itself, but it is recently required that the ignition coil portion 50 is miniaturized. For example, since the ignition coil portion 50 must be accommodated within the plug hole that is deeply provided, such as the DOHC engine, the primary winding L1 and the secondary winding L2 are wound around a coil core forming an open magnetic circuit in most cases. However, the ignition coil 50 of open magnetic circuit type because a magnetic flux is passed around the outside of the coil core (in the atmosphere) as a magnetic path, when conducting to the primary winding L1, resulting in more magnetic resistance, sometimes giving rise to a magnetic leakage, whereby there is a risk that the high voltage for ignition to be supplied to the spark plug 100 has some loss. On the contrary, the second barrel portion 65 for accommodating the coil core (ignition coil portion 50) forming an open magnetic circuit is made of a ferromagnetic material, so that a magnetic flux is passed via the second barrel portion 65 located outside the coil core (in other words, substantially forming a closed magnetic circuit). Consequently, the magnetic flux resistance can be reduced, and the magnetic leakage can be suppressed.

However, if the first barrel portion 64 is also made of a ferromagnetic material, the magnetic path is formed of three members, the coil core, the second barrel portion 65 and the first barrel portion 64, but since the distance between the first barrel portion 64 and the coil core is longer than that between the second barrel portion 65 and the coil core, the distance by which the magnetic flux is passed through the atmosphere is slightly extended, with the possibility that the magnetic flux leakage can not be suppressed efficiently. Thereby, the barrel portion has a dual structure in which the first barrel portion 64 is made of a paramagnetic material and the second barrel portion 65 is made of a ferromagnetic material, as described above, forming an efficient magnetic path, so that the loss in the high voltage for ignition to be supplied from the ignition coil portion 50 to the spark plug 100 can be suppressed.

A projection portion 52 that can be attached removably on a cylinder head SH is formed at a predetermined location on an outer circumferential face of the second barrel portion 65.

Figure 14:
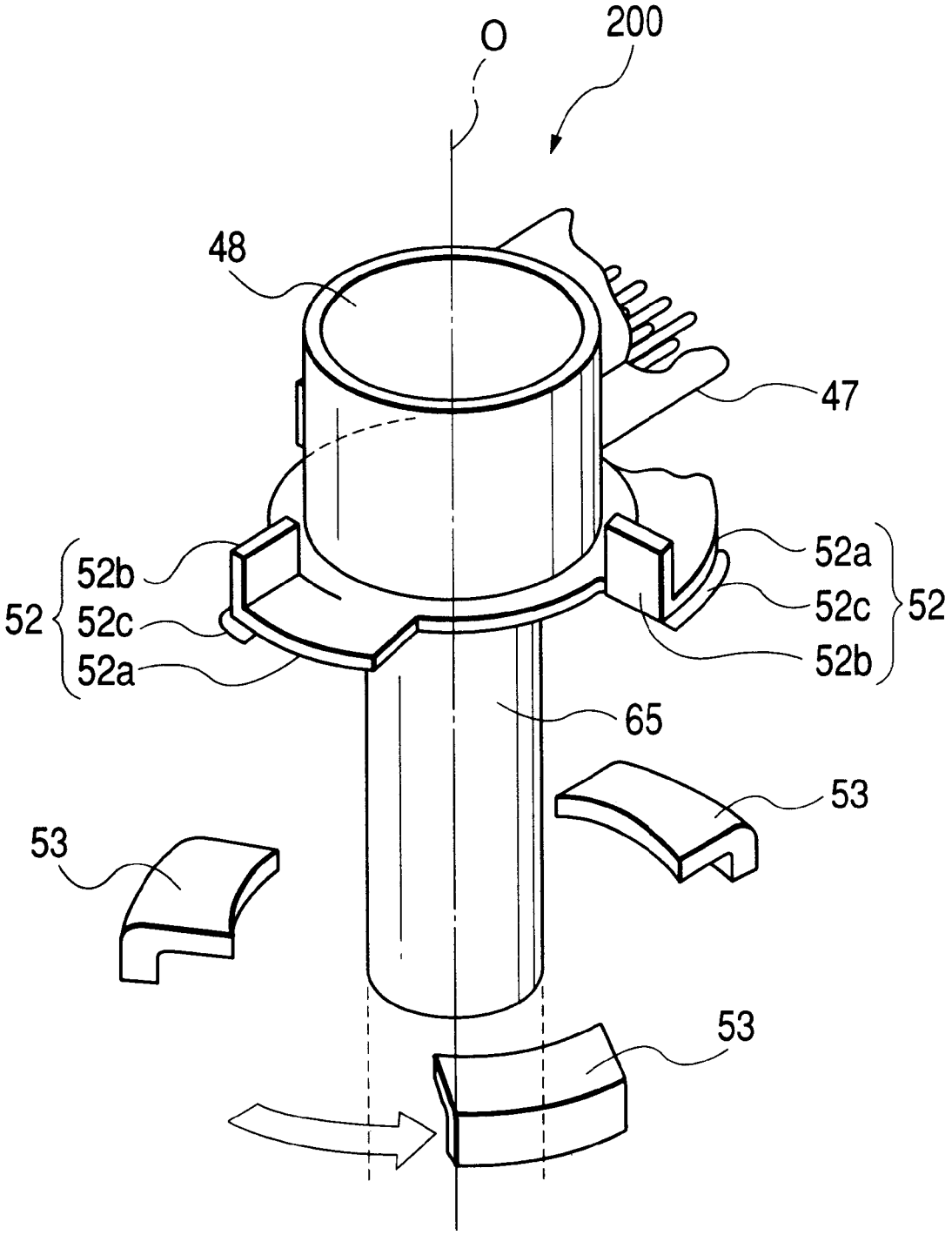
FIG. 14 is a perspective view, in enlargement, of a projection portion.

Herein, the projection portion 52 will be described below in detail. FIG. 14 is a perspective view, in enlargement, of the projection portion 52. As shown in FIG. 14, plurality of (three in this example) projection portions 52 are projected radially outwardly at an equal interval from the outer circumferential face of the second barrel portion 65. Herein, this projection portion 52 has a first plate plane 52*a* and a second plate plane 52*b*, which are integrally connected.

The first plate plane 52*a* corresponds to a portion fitted with any one of a plurality of (three in this example) attaching members 53 of almost L-character shape in cross section which are provided beforehand in the cylinder head SH. Also, the second plate plane 52*b* is stood almost vertically to the first plate plane 52*a*, and brought into contact with an attaching member 53 to serve to restrict the movement of the first plate plane 52*a*, when the first plate plane 52*a* is fitted with the attaching member 53 of the cylinder head SH.

Further, a plate plane 52*c* that occupies almost one-half of the first plate plane 52*a* on the side of the second plate plane 52*b* stood is warped slightly upward in the figure from a boundary part to the other almost one-half of the first plate plane 52*a*. This plate plane 52*c* functions as an elastic part exhibiting a pressure action against the cylinder head SH, when or after the first plate plane 52*a* is fitted with the attaching member 53 of the cylinder head SH. With this elastic part (plate plane 52*c*), the coil integral-type spark plug 200 is urged toward a combustion chamber 55 (in other words, toward the top end in the axial direction O).

Turning back to FIG. 13, the ignition unit 48 is mounted on the base end portion of the second barrel portion 65, and comprises the connector portion 47 for connecting to an external device such as a power source unit or an electronic control unit, and internally a switching element. And the switching element is operated, upon an instruction signal (ignition instruction signal) from the external device, to conduct or shut off a primary current flowing through the primary winding L1 of the ignition coil portion 50, and develop a high voltage for ignition at the secondary winding L2, whereby a spark discharge is produced by applying this high voltage for ignition to the spark plug.

Referring now to FIG. 15, an assembling procedure of the coil integral-type spark plug 200 composed of the above components will be described below by way of example.

Figure 15A:
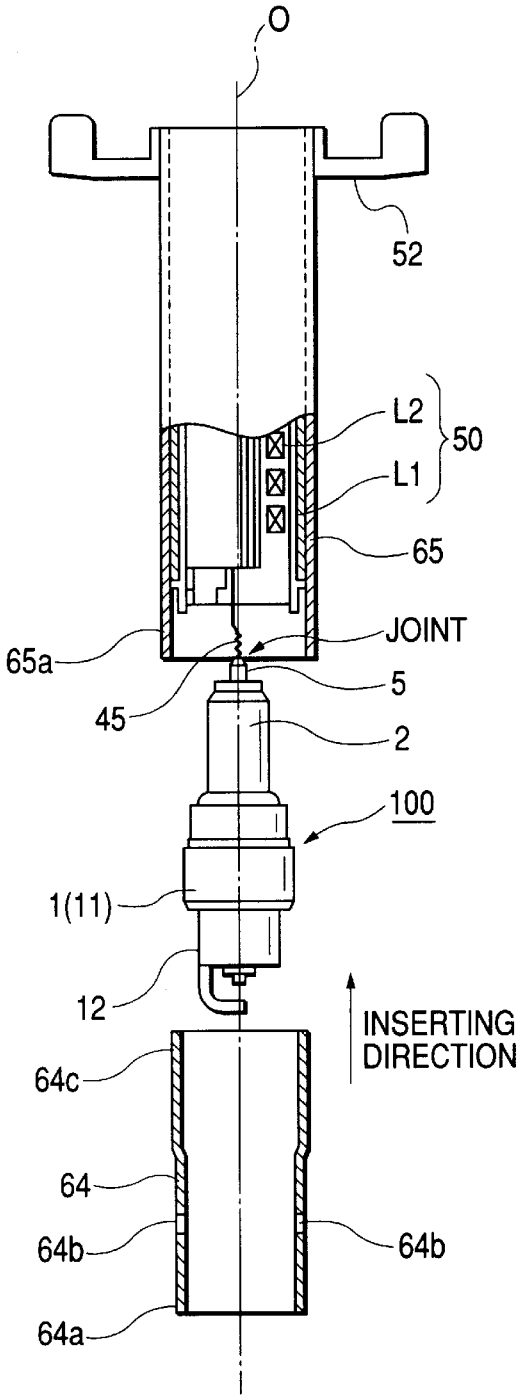
FIG. 15A shows a state before assembly and FIG. 15B shows a state after assembly.

First of all, the ignition coil portion 50 is accommodated inside the spark plug 200, and the second barrel portion 65 internally molded of epoxy resin that is an insulating resin is prepared. Then, a connection terminal 45 connected to the secondary winding L2 of the ignition coil portion 50 that is led out of the top end side of the second barrel portion 65, and a terminal electrode 5 of the spark plug 100 are joined by caulking or brazing, as shown in FIG. 15A. Inside the second barrel portion 65, a part of the connection terminal 45 is led out without being molded of epoxy resin.

Figure 15B:
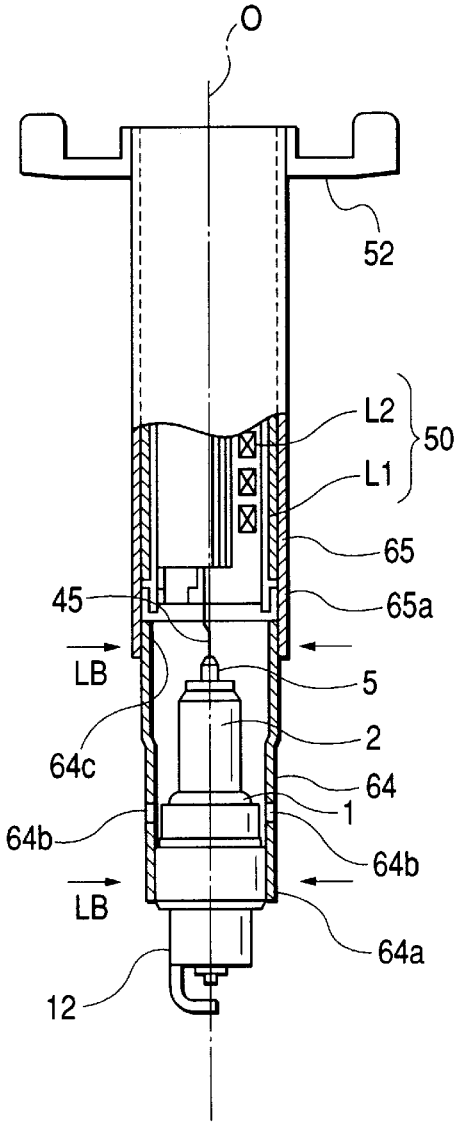

Then, the first barrel portion 64 formed with the filler hole 64*b* is prepared, and inserted (fitted) from a front side of the spark plug 100 in the axial direction O. And the first barrel portion 64 is disposed to have its top end portion producing the first overlapping portion 64*a* with a flange portion 11 of the main metal shell 1 of the spark plug 100, and to have its base end portion producing the second overlapping portion 64 with an inner face of the top end portion 65*a* of the second barrel portion 65. The first overlapping portion 64*a* and the second overlapping portion 64*c* are subjected to laser welding (corresponding to LB in the figure), as shown in FIG. 15B.

At this time, the position of the ground electrode 4 of the spark plug 100 relative to the position where the projection portion 52 of the second barrel portion 65 is formed (or the connecting position to the main metal shell 1) is adjusted in such a positional relation that a turbulent flow of the air-fuel mixture may not be prevented from contacting with a spark discharge developed at the spark discharge gap g, when the coil integral-type spark plug 200 is mounted on the cylinder head, and the first barrel portion 64 is integrated with the main metal shell 1 of the spark plug 100 and the second barrel portion 65.

After the spark plug 100, the ignition coil portion 50, the first barrel portion 64 and the second barrel portion 65 are integrally formed in the above way, an insulating material (e.g., silicone rubber or silicone resin) is filled and fixed through the filler hole 64*b* into the first barrel portion 64 in a liquefied state, and a layer having the same thickness as the second barrel portion 65 is formed of the same insulating material on an outer circumferential surface of the first barrel portion 64, thereby forming an insulating portion 66 consisting of a portion formed inside the first barrel portion 64 and the layer on the outer circumferential surface of the first barrel portion 64 (see FIG. 13). The insulating portion 66 is formed to cover a caulking portion 71 of the spark plug 100 inside the first barrel portion 64.

In this way, a coil integral-type spark plug 200 is completed.

Figure 16:
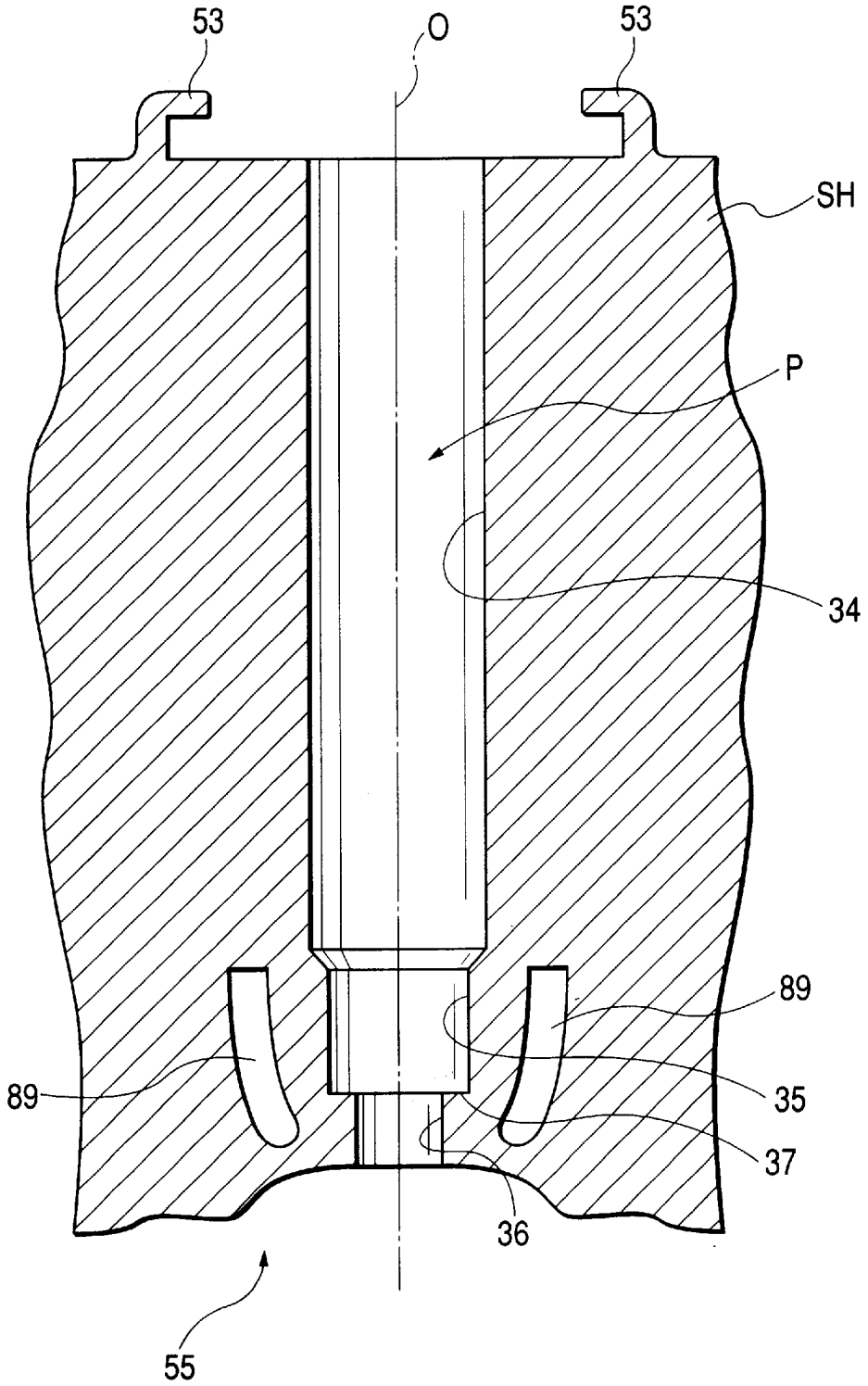
FIG. 16 is a cross-sectional view of a cylinder head of the example 3.

Herein, FIG. 16 shows the cylinder head SH of this example. As shown in FIG. 16, the cylinder head SH has a plug hole P penetrating from an upper face with the attaching portion 53 into the combustion chamber 55. And the plug hole P is formed deep enough to receive the coil integral-type spark plug 200 fully, and consists of a round hole having the diameter gradually becoming smaller from the upper face of the cylinder head SH to the combustion chamber 55.

Of the round hole making up the plug hole P, an insertion portion 34 on the upper face side extends from the upper face of the cylinder head SH near the combustion chamber 55, and is formed in larger diameter than the second barrel portion 65 that has the largest diameter of the coil integral-type spark plug 200, so that the coil integral-type spark plug 200 can be inserted with a play. Also, a top end counterpart 36 of the round hole on the side of the combustion chamber 55 has a top end portion 12 of the main metal shell 1 inserted with a play, when the coil integral-type spark plug 200 is inserted. Also, a flange counterpart 35, which is located between the insertion portion 34 and the top end counterpart 36, is a round bore into which the flange portion 11 of the main metal shell 1 is inserted with a play, when the coil integral-type spark plug 200 is inserted.

A seal face 37 at the boundary part between the flange counterpart 35 and the top end counterpart 36 is contacted by a gasket G that is attached on the coil integral-type spark plug 200, and serves to retain the air tightness with the combustion chamber 55. Also, the cylinder head SH is formed with a circulation hole 89 for circulating the cooling water.

A procedure for mounting the coil integral-type spark plug 200 of this example on the cylinder head will be described below. First of all, the coil integral-type spark plug 200 is inserted into the plug hole P of the cylinder head SH from the side of the spark plug 100. And the coil integral-type spark plug 200 is inserted until the first plate plane 52*a* of the projection portion formed cylindrically comes into contact with the upper face of the cylinder head SH, and then the coil integral-type spark plug 200 is rotated around the axis O so that the projection portion 52 and the attaching portion 53 are fitted together.

At this time, the coil integral-type spark plug 200 is adjusted so that it may be urged in a direction toward the combustion engine 55 (or the top end side in the axial direction O) with a force of 20 [N/mm$^2$] by the elastic portion (plate plane 52*c*) that is a part of the first plate plane 52*a* forming the projection portion 52 (see FIG. 14).

In this way, the coil integral-type spark plug 200 can be mounted on the cylinder head SH, but in this embodiment, the clearance amount ($\phi D-\phi d$) satisfies a relation $\phi D-\phi d \leqq 0.15$ (unit: mm) in its mounted structure, where the outer diameter of the top end portion 12 in the main metal shell 1 is $\phi d$, and the hole diameter of the top end counterpart 36 in the plug hole P is $\phi D$, as shown in FIG. 13. Herein, the hole diameter $\phi D$ of the top end counterpart 36 in the plug hole P varies depending on each design of the cylinder head SH, but if the outer diameter $\phi d$ of the top end portion 12 is appropriately set to satisfy the above range (relation) for any plug hole P, the above range can be effectuated. In this embodiment, $\phi D$ is set to 13.70 [mm], and $\phi d$ is set to 13.60 [mm], so that $\phi D-\phi d$ is equal to 0.10 [mm], for example.

In this way, if the clearance amount ($\phi D-\phi d$) is set to 0.15 [mm] or less, a heat flowing from the center electrode 3, the insulator 2, and the ground electrode 4 into the top end portion 12 of the main metal shell 1 can be promptly diffused into the inner wall face of the plug hole P (cylinder head SH). Consequently, the center electrode 3, the insulator 2 and the ground electrode 4 are maintained at low temperatures, giving rise to the preignition resistance equivalent or superior to that of the spark plug having the thread groove formed in the top end portion 12 as conventionally made.

Further, in this example 3, since the coil integral-type spark plug is employed, the spark plug can be amounted easily and correctly on the plug hole, even in the case where the clearance amount ($\phi D-\phi d$) between the hole diameter ($\phi D$) of the top end counterpart 36 in the plug hole P and the outer diameter ($\phi d$) of the top end portion 12 in the main metal shell 1 is as quite small as 0.51 mm or less.

While there has been described in connection with the preferred embodiment of the invention, it will be obvious to those skilled in the art that various changes and modifications may be made therein without departing from the invention, and it is aimed, therefore, to cover in the appended claim all such changes and modifications as fall within the true spirit and scope of the invention.

With the present invention, it is possible to provide a spark plug and a spark plug mounting structure for mounting the spark plug into a plug hole formed in a cylinder head, in which the spark plug is easily mounted in the plug hole and can diffuse the heat excellently to have an improved heat resistance.

What is claimed is:

1. A spark plug adapted to be mounted in a plug hole formed in a cylinder head, said spark plug comprising:

a central electrode extending in an axial direction thereof;

an insulator having a tip end portion which surrounds said central electrode; and a main metal shell provided around said insulator, said main metal shell having a flange portion with a plug bearing surface at a tip end of said flange portion, and said main metal shell having a top end portion which extends in an axial direction thereof from said plug bearing surface to a tip end side of the main metal shell, wherein the top end portion of said main metal shell is formed into a substantially cylindrical shape having an outer circumferential face on which no external thread is provided, and the outer diameter of the top end portion satisfying a following relation, $$\phi D-\phi d \leqq 0.15$$

where $\phi d$ (unit: mm) defines the outer diameter of said top end portion of said main metal shell, and $\phi D$ (unit: mm) denotes the inner diameter of a top end counterpart of said plug hole where is in confront with said top end portion.

2. The spark plug according to claim 1, wherein said main metal shell comprises:

an engaging portion, protruded inwardly from the inner circumferential face of said main metal shell, for engaging said insulator so as to prevent said insulator from moving in the axial direction, wherein said engaging portion has a base end which is positioned to satisfy a relation $$-6 \text{ mm} \leqq L \leqq 6 \text{ mm}$$

where L defines a distance along the axial direction of the spark plug between said plug bearing surface and the base end side edge of said engaging portion.

3. The spark plug according to claim 2, further comprising:

at least one ground electrode having one end which is connected to said main metal shell and the other end which is opposed to said central electrode through a spark discharge gap; and a fitting position restriction member, engaged with a mating portion formed on the plug hole, for restricting a fitting position of said spark plug relative to said plug hole in a rotating direction of the spark plug about the axis of the spark plug.

4. The spark plug according to claim 3, wherein said spark plug is a coil integral-type spark plug comprising:

a barrel portion secured on said main metal shell in a unrotatable manner about the axis of said spark plug; and an ignition coil portion, which is accommodated within said barrel portion, for applying a high voltage for ignition to said spark plug.

5. The spark plug according to claim 2, wherein said spark plug is a coil integral-type spark plug comprising:

a barrel portion secured on said main metal shell in a unrotatable manner about the axis of said spark plug; and an ignition coil portion, which is accommodated within said barrel portion, for applying a high voltage for ignition to said spark plug.

6. The spark plug according to claim 1, further comprising:

at least one ground electrode having one end which is connected to said main metal shell and the other end which is opposed to said central electrode through a spark discharge gap; and a fitting position restriction member, engaged with a mating portion formed on the plug hole, for restricting a fitting position of said spark plug relative to said plug hole in a rotating direction of the spark plug about the axis thereof.

7. The spark plug according to claim 6, wherein said spark plug is a coil integral-type spark plug comprising:

a barrel portion secured on said main metal shell in a unrotatable manner about the axis of said spark plug; and an ignition coil portion, which is accommodated within said barrel portion, for applying a high voltage for ignition to said spark plug.

8. The spark plug according to claim 1, wherein said spark plug is a coil integral-type spark plug comprising:

a barrel portion secured on said main metal shell in a unrotatable manner about the axis of said spark plug; and an ignition coil portion, which is accommodated within said barrel portion, for applying a high voltage for ignition to said spark plug.

9. A mounting structure comprising:

a spark plug including, a central electrode extending in an axial direction thereof, an insulator having a tip end portion which surrounds said central electrode, and a main metal shell provided around said insulator, said main metal shell having a flange portion with a plug bearing surface at a tip end of said flange portion, and said main metal shell having a top end portion which extends in an axial direction thereof from said plug bearing surface to a tip end side of the main metal shell; and a cylinder head having plug hole with a top end counterpart which receives the top end portion of said main metal shell, wherein the top end portion of said main metal shell is formed into a substantially cylindrical shape having an outer circumferential face on which no external thread is provided, and the top end portion of said main metal shell and the top end counterpart of said plug hole satisfies a following relation, $$\Phi D-\Phi d \leqq 0{,}15$$

where Φd (unit: mm) defines the outer diameter of said top end portion, and ΦDD (unit: mm) denotes the inner diameter of the top end counterpart.

10. The mounting structure according to claim 9, wherein said main metal shell comprises:

an engaging portion, protruded inwardly from the inner circumferential face of said main metal shell, for engaging said insulator so as to prevent said insulator from moving in the axial direction, and wherein said engaging portion has a base end side edge which is positioned to satisfy a relation $$-6\ \text{mm} \leqq L \leqq 6\ \text{mm}$$

where L defines a distance along the axial direction of the spark plug between said plug bearing surface and the base end side edge of said engaging portion.

11. The mounting structure according to claim 10, wherein said spark plug is a coil integral-type spark plug comprising:

a barrel portion secured on said main metal shell in a unrotatable manner about the axis of said spark plug; and an ignition coil portion, which is accommodated within said barrel portion, for applying a high voltage for ignition to said spark plug.

12. The mounting structure according to claim 10, further comprising:

a fitting position restriction member formed on said spark plug; and a mating portion formed on the plug hole and engaged with said fitting position restriction member, thereby restricting a fitting position of said spark plug relative to said plug hole in a rotating direction of the spark plug about the axis thereof.

13. The mounting structure according to claim 10, wherein the base end side edge is positioned to satisfy a relation ti $-3\ \text{mm} \leqq L \leqq 3\ \text{mm}$ where L defines a distance along the axial direction of the spark plug between said plug bearing surface and the base end side edge of said engaging portion.

14. The mounting structure according to claim 9, wherein said spark plug is a coil integral-type spark plug comprising:

a barrel portion secured on said main metal shell in a unrotatable manner about the axis of said spark plug; and an ignition coil portion, which is accommodated within said barrel portion, for applying a high voltage for ignition to said spark plug.

15. The mounting structure according to claim 9, further comprising:

a fitting position restriction member formed on said spark plug; and a mating portion formed on the plug hole and engaged with said fitting position restriction member, thereby restricting a fitting position of said spark plug relative to said plug hole in a rotating direction of the spark plug about the axis thereof.

16. The mounting structure according to claim 9, wherein the top end portion of said main metal shell and the top end counter part of said plug hole satisfies a following relation, $$0.05 \leqq \Phi D-\Phi d \leqq 0.15$$

where Φd (unit: mm) defines the outer diameter of said top end portion, and ΦD (unit: mm) denotes the inner diameter of the top end counterpart.

17. The mounting structure according to claim 9, wherein the top end portion of said main metal shell and the top end counter part of said plug hole satisfies a following relation.

$$0.0523\ \Phi D-\Phi d \leqq 0.10$$

where Φd (unit: mm) defines the outer diameter of said top end portion, and ΦD (unit: mm) denotes the inner diameter of the end counterpart.

* * * * *

UNITED STATES PATENT AND TRADEMARK OFFICE

CERTIFICATE OF CORRECTION

PATENT NO. : 6,617,769 B2
DATED : September 9, 2003
INVENTOR(S) : Takahiro Suzuki It is certified that error appears in the above-identified patent and that said Letters Patent is hereby corrected as shown below:

Title page,
Item [*] Notice, delete the phrase “by 0 days” and insert -- by 55 days --

Signed and Sealed this

Twenty-eighth Day of June, 2005

JON W. DUDAS
*Director of the United States Patent and Trademark Office*